US007631386B1

(12) United States Patent
Santiago et al.

(10) Patent No.: US 7,631,386 B1
(45) Date of Patent: Dec. 15, 2009

(54) COMPACT CARPET SPOT CLEANER

(75) Inventors: Jose Carlito Santiago, Grand Rapids, MI (US); Eric C. Huffman, Lowell, MI (US); Timothy S. Parker, Rockford, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 750 days.

(21) Appl. No.: 10/904,331

(22) Filed: Nov. 4, 2004

Related U.S. Application Data

(60) Provisional application No. 60/481,645, filed on Nov. 14, 2003, provisional application No. 60/554,574, filed on Mar. 19, 2004.

(51) Int. Cl.
*A47L 11/00* (2006.01)

(52) U.S. Cl. ..... 15/22.1; 15/24; 15/29

(58) Field of Classification Search ..... 15/29, 15/31, 22.1, 28, 24
See application file for complete search history.

(56) References Cited

U.S. PATENT DOCUMENTS

| | | | | |
|---|---|---|---|---|
| 0,793,587 | A | 6/1905 | Johnson | |
| 3,178,754 | A | 4/1965 | Cleverdon | |
| 3,315,693 | A | 4/1967 | Braun | |
| 3,516,424 | A * | 6/1970 | Eagle | 132/148 |
| 3,904,088 | A | 9/1975 | Milbourne | |
| 3,932,909 | A * | 1/1976 | Johnson et al. | 15/29 |
| 3,935,869 | A | 2/1976 | Reinsch | |
| 3,978,852 | A | 9/1976 | Annoni | |
| 4,156,620 | A | 5/1979 | Clemens | |
| 4,168,560 | A | 9/1979 | Doyel | |
| 4,223,417 | A | 9/1980 | Solow | |
| 4,277,001 | A | 7/1981 | Nozawa | |
| 4,371,098 | A | 2/1983 | Nozawa | |
| 4,545,087 | A | 10/1985 | Nahum | |
| 4,775,079 | A | 10/1988 | Grothoff | |
| 4,942,985 | A | 7/1990 | Schultz | |
| 5,020,179 | A | 6/1991 | Scherer | |
| 5,138,733 | A | 8/1992 | Bock | |
| 5,142,723 | A * | 9/1992 | Lustig et al. | 15/22.1 |
| 5,158,211 | A | 10/1992 | Meshberg | |
| 5,177,826 | A | 1/1993 | Vrignaud et al. | |
| 5,222,636 | A | 6/1993 | Meuresch | |
| 5,359,747 | A | 11/1994 | Amakasu | |
| 5,369,831 | A | 12/1994 | Bock | |
| 5,546,624 | A | 8/1996 | Bock | |

(Continued)

FOREIGN PATENT DOCUMENTS

| | | |
|---|---|---|
| EP | 0629694 | 6/2000 |

(Continued)

*Primary Examiner*—Dung Van Nguyen
(74) *Attorney, Agent, or Firm*—McGarry Bair PC

(57) ABSTRACT

A handheld cleaning apparatus for cleaning carpets and other surfaces comprises a housing, a motorized cleaning head, and a liquid container assembly removably mounted to the housing for storing and dispensing a cleaning liquid onto the surface to be cleaned. The housing and the cleaning head are designed such that the user can easily and comfortably apply a downward force to the cleaning head. Additionally, the liquid container preferably comprises a manual spray dispenser having an outlet orifice that is offset from the cleaning head for unobstructed dispensation of cleaning fluid onto the surface to be cleaned. A selectively heated pressure tip with a rounded end is mounted to the cleaning head for cleaning stains.

57 Claims, 20 Drawing Sheets

U.S. PATENT DOCUMENTS

| | | | | |
|---|---|---|---|---|
| 5,620,113 | A | 4/1997 | Meshberg | |
| 5,625,916 | A * | 5/1997 | McDougall | 15/28 |
| 5,636,400 | A * | 6/1997 | Young | 15/23 |
| 5,697,115 | A | 12/1997 | Sciarra et al. | |
| 5,706,541 | A | 1/1998 | Gutelius et al. | |
| 5,718,014 | A | 2/1998 | deBlois et al. | |
| 5,857,233 | A * | 1/1999 | Wynn | 15/97.1 |
| 5,875,932 | A | 3/1999 | Meshberg | |
| 5,956,792 | A | 9/1999 | Gutelius et al. | |
| 5,978,999 | A | 11/1999 | deBlois et al. | |
| 6,043,209 | A | 3/2000 | Micciche et al. | |
| 6,187,738 | B1 | 2/2001 | Micciche et al. | |
| 6,292,971 | B1 * | 9/2001 | Chaudray | 15/29 |
| 6,382,463 | B2 | 5/2002 | Meshberg | |
| 6,391,061 | B1 | 5/2002 | Hortel et al. | |
| 6,434,773 | B1 * | 8/2002 | Kuo | 15/22.1 |
| 6,583,103 | B1 | 6/2003 | Klinkhammer | |
| 6,589,294 | B2 | 7/2003 | Hortel et al. | |
| 6,648,641 | B1 * | 11/2003 | Viltro et al. | 433/80 |
| 6,693,068 | B1 | 2/2004 | Ryan et al. | |
| 6,736,857 | B2 | 5/2004 | Chang et al. | |
| 6,739,481 | B2 | 5/2004 | Meshberg | |
| 7,213,289 | B2 * | 5/2007 | Jaffe | 15/28 |
| 2002/0112741 | A1 | 8/2002 | Pieroni et al. | |
| 2002/0129835 | A1 | 9/2002 | Pieroni et al. | |
| 2002/0179124 | A1 | 12/2002 | Van Hauwermeiren et al. | |
| 2002/0189635 | A1 | 12/2002 | Bodet et al. | |
| 2003/0056307 | A1 * | 3/2003 | Tybinkowski et al. | 15/29 |
| 2003/0079305 | A1 | 5/2003 | Takahata et al. | |
| 2003/0164178 | A1 | 9/2003 | Masotti et al. | |
| 2003/0177595 | A1 * | 9/2003 | Quach | 15/29 |
| 2003/0213817 | A1 | 11/2003 | Meshberg | |
| 2003/0221269 | A1 | 12/2003 | Zhuan | |
| 2004/0016059 | A1 | 1/2004 | Dresco et al. | |
| 2004/0107508 | A1 | 6/2004 | Chang et al. | |

FOREIGN PATENT DOCUMENTS

| | | |
|---|---|---|
| GB | 2058229 | 4/1981 |
| JP | 05-095816 | 4/1993 |
| JP | 08-103331 | 4/1996 |
| WO | WO2004/035725 | 4/2004 |

* cited by examiner

COMPACT CARPET SPOT CLEANER

CROSS REFERENCE TO RELATED APPLICATIONS

This application claims the benefit of U.S. Patent Application No. 60/481,645, filed Nov. 14, 2003, and U.S. Patent Application No. 60/554,574, filed Mar. 19, 2004.

FIELD OF THE INVENTION

The invention relates to a handheld surface cleaning apparatus. In one aspect, the invention relates to a handheld surface cleaning apparatus comprising a cleaning head mounted to a housing designed so that a user can easily and comfortably apply downward pressure on the cleaning head against the surface to be cleaned. In another aspect, the invention relates to a handheld surface cleaning apparatus comprising a liquid container with a manual pump dispenser for spraying liquid onto the surface to be cleaned. In yet another aspect, the invention relates to a handheld surface cleaning apparatus comprising a cleaning head on a housing and a liquid container mounted to the housing and having an outlet orifice that is offset from the cleaning head so that the cleaning head does not interfere with dispensation of liquid from the liquid container.

DESCRIPTION OF THE RELATED ART

Many apparatuses, such as upright extractors and canister extractors, have been developed to deep clean carpets and upholstery. However, these devices are generally bulky and inconvenient to use for cleaning relatively small spots in the home and are awkward to use in areas outside the home, such as in automobiles. A small, portable handheld device is preferred for cleaning small spots both in the home and in environments outside the home.

Battery driven, handheld cleaning devices are known. For example, U.S. Pat. No. 4,168,560, issued Sep. 25, 1979 to Doyle, discloses a battery driven cleaning device with a housing, a motorized agitator, and a cleaning agent reservoir removably mounted to the housing for dispensing a cleaning agent through a gravity feed system. The device requires four "D" cell batteries, which are large and necessarily create a large and bulky device. Further, the handle on the housing is substantially perpendicular to the agitator, which is at an inappropriate ergonomic angle for a user. As a result, the user may have difficulty in effectively and comfortably applying downward force to the agitator.

Many carpet cleaning compositions have been developed for use with different types of carpet cleaning equipment. Cleaning compositions with oxidizing agents are known to be effective at removing spots and stains from a variety of surfaces, such as upholstery and flooring surfaces, including carpets. For example, U.S. Pat. No. 6,043,209, issued Mar. 28, 2000 to Micciche et al., discloses an aqueous composition for cleaning fabrics and carpets including a water miscible organic solvent, a peroxygen compound, a surfactant, a polymeric or copolymeric soil resist, and a fluorinated hydrocarbon soil resist. The solvent is selected from isopropanol, propylene glycol-methyl ether, dipropylene glycol methyl ether, or combinations thereof. Compositions formed with these solvents and both soil resists are particularly stable and non-turbid. The composition is said to be useful for removing oil and grease stains from fabrics and carpets. Another example of an aqueous composition for cleaning carpets and fabrics and having a peroxygen compound is U.S. Pat. No. 6,187,738, issued Feb. 13, 2001 to Micciche et al. In addition to the peroxygen compound, the composition comprises a surfactant system and a polymeric or copolymeric soil resist. It is said that sodium lauroyl sulfate when used as a surfactant produces a composition which is useful for removing water and protein stains from fabrics and carpets.

It is therefore desirable to have a handheld surface cleaning apparatus that is portable, lightweight, effective, and easy to use and is adapted to store and dispense a suitable cleaning liquid.

SUMMARY OF THE INVENTION

A handheld surface cleaning apparatus according to one embodiment of the invention comprises a housing having a gripping handle at a rear portion with a first longitudinal axis and a head portion at a front portion thereof; a cleaning head mounted to the head portion and having bristles that extend at an obtuse angle to first longitudinal axis; a motor within the housing and mechanically connected to the cleaning head through a drive mechanism; a source of electrical energy connected to the motor to energize the motor; a switch mounted on the housing and connected between the source of electrical energy and the motor to control the application of electrical energy to the motor; a liquid container mounted on the housing and adapted to contain a cleaning fluid; and a dispenser mounted on the liquid container for dispensing the cleaning fluid from the liquid container and onto a surface to be cleaned; whereby the gripping handle is ergonomically positioned for a user when the bristles are positioned substantially perpendicular to a surface to be cleaned.

In one embodiment, the liquid container is removably mounted to the head portion of the housing so that the dispenser is positioned adjacent to the cleaning head.

In another embodiment, the source of electrical energy is mounted within the gripping handle. In a preferred embodiment, the source of electrical energy is a battery.

In yet another embodiment, the liquid container is slidably mounted to the head portion. Preferably, a side wall of the liquid container mates with the head portion in piggyback fashion. The side wall of the liquid container has an indentation that snap fits or slides onto the head portion in piggyback fashion.

In another embodiment, the dispenser has a manual pump for spraying liquid onto the surface to be cleaned.

In still another embodiment, the dispenser is positioned at a forward end of the liquid container.

In one embodiment, the liquid container has a third longitudinal axis that is substantially coincident with the first longitudinal axis when the liquid container is mounted to the housing. Preferably, the dispenser is mounted forwardly of the cleaning head, and the dispenser has an outlet orifice that is offset from the cleaning head.

In another embodiment, the cleaning head is removably mounted to the head portion. Optionally, the cleaning head snap fits onto the head portion.

In one embodiment, the cleaning head bristles comprise a set of bristles that are stationary with respect to the cleaning head and a set of movable bristles that are moveable with respect to the cleaning head. Preferably, the set of movable bristles moves reciprocally in a forward and rearward direction. Optionally, one of the sets of bristles is shorter than the other set of bristles, and the set of movable bristles is shorter than the set of stationary of bristles and is centrally located with respect to the set of stationary bristles.

In another embodiment, the switch is mounted on the gripping handle so that a user can operate the switch with a thumb.

In one embodiment, the obtuse angle between the first longitudinal axis and the bristles is in a range of about 95 to 120 degrees. Preferably, the obtuse angle between the first longitudinal axis and the bristles is about 100 degrees.

In another embodiment, the head portion extends along a second longitudinal axis that is at an acute angle with respect to the first longitudinal axis. The acute angle between the first longitudinal axis and the second longitudinal axis is in a range of about 10 to 30 degrees. In still another embodiment, the bristles extend at an obtuse angle to the second longitudinal axis, and the obtuse angle between the bristles and the second longitudinal axis is in a range of about 110 to 130 degrees and is preferably about 120 degrees. In yet another embodiment, the difference between the acute angle between the first and second longitudinal axes and the obtuse angle between the bristles and the second longitudinal axis is greater than 90 degrees.

A handheld surface cleaning apparatus according to another embodiment of the invention comprises a housing having a head portion and a rear portion with a gripping handle; a cleaning head mounted to the head portion; a motor within the housing and mechanically connected to the cleaning head through a drive mechanism; a source of electrical energy connected to the motor to energize the motor; a switch mounted on the housing and connected between the source of electrical energy and the motor to control the application of electrical energy to the motor; a liquid container mounted on the housing and adapted to contain a cleaning fluid; and a dispenser mounted on the liquid container for dispensing the cleaning fluid from the liquid container and onto a surface to be cleaned; wherein the dispenser has a manual pump for spraying liquid onto the surface to be cleaned.

In another embodiment, the dispenser is positioned at a forward end of the liquid container.

In yet another embodiment, the liquid container is removably mounted to the head portion of the housing so that the dispenser is positioned adjacent to the cleaning head. Optionally, the liquid container is slidably mounted to the head portion. Preferably, a side wall of the liquid container mates with the head portion in piggyback fashion, and the side wall of the liquid container has an indentation that snap fits or slides onto the head portion in piggyback fashion.

In one embodiment, the cleaning head comprises bristles. Preferably, the cleaning head is removably mounted to the head portion. Optionally, the cleaning head comprises a set of stationary bristles and a set of movable bristles that is moveable with respect to the cleaning head.

A handheld surface cleaning apparatus according to another embodiment of the invention comprises a housing having a head portion and a rear portion with a gripping handle; a cleaning head mounted to the head portion; a motor within the housing and mechanically connected to the cleaning head through a drive mechanism; a source of electrical energy mounted in the housing and connected to the motor to energize the motor; a switch mounted on the housing and connected between the source of electrical energy and the motor to control the application of electrical energy to the motor; a liquid container mounted on the housing and adapted to contain a cleaning fluid; and a dispenser mounted on the liquid container for dispensing the cleaning fluid from the liquid container and onto a surface to be cleaned; wherein the dispenser has an outlet orifice offset from the cleaning head.

In one embodiment, the outlet orifice is angularly offset from the cleaning head. In another embodiment, the outlet orifice is laterally offset from the cleaning head.

In another embodiment, the dispenser is positioned at a forward end of the liquid container.

In yet another embodiment, the liquid container is removably mounted to the head portion of the housing so that the dispenser is positioned adjacent to the cleaning head. Optionally, the liquid container is slidably mounted to the head portion. Preferably, a side wall of the liquid container mates with the head portion in piggyback fashion, and the side wall of the liquid container has an indentation that snap fits or slides onto the head portion in piggyback fashion.

In one embodiment, the cleaning head comprises bristles. Preferably, the cleaning head is removably mounted to the head portion. Optionally, the cleaning head comprises a set of stationary bristles and a set of movable bristles that is movable with respect to the cleaning head.

In yet another embodiment, the handheld surface cleaning apparatus comprises a housing having a head portion and a rear portion with a gripping handle with a cleaning head mounted to the head portion wherein the cleaning head includes a pressure tip to precisely apply pressure to the surface to be cleaned. The housing can also include a source of electrical energy and a switch to selectively to heat the pressure tip. A motor within the housing is mechanically connected to the cleaning head through a drive mechanism. In still another embodiment the invention, a liquid container is mounted on the housing and is adapted to carry a cleaning fluid with a dispenser mounted on the liquid container for dispensing the cleaning fluid from the liquid container and onto a surface to be cleaned.

DESCRIPTION OF THE PREFERRED EMBODIMENTS

Figure 1:
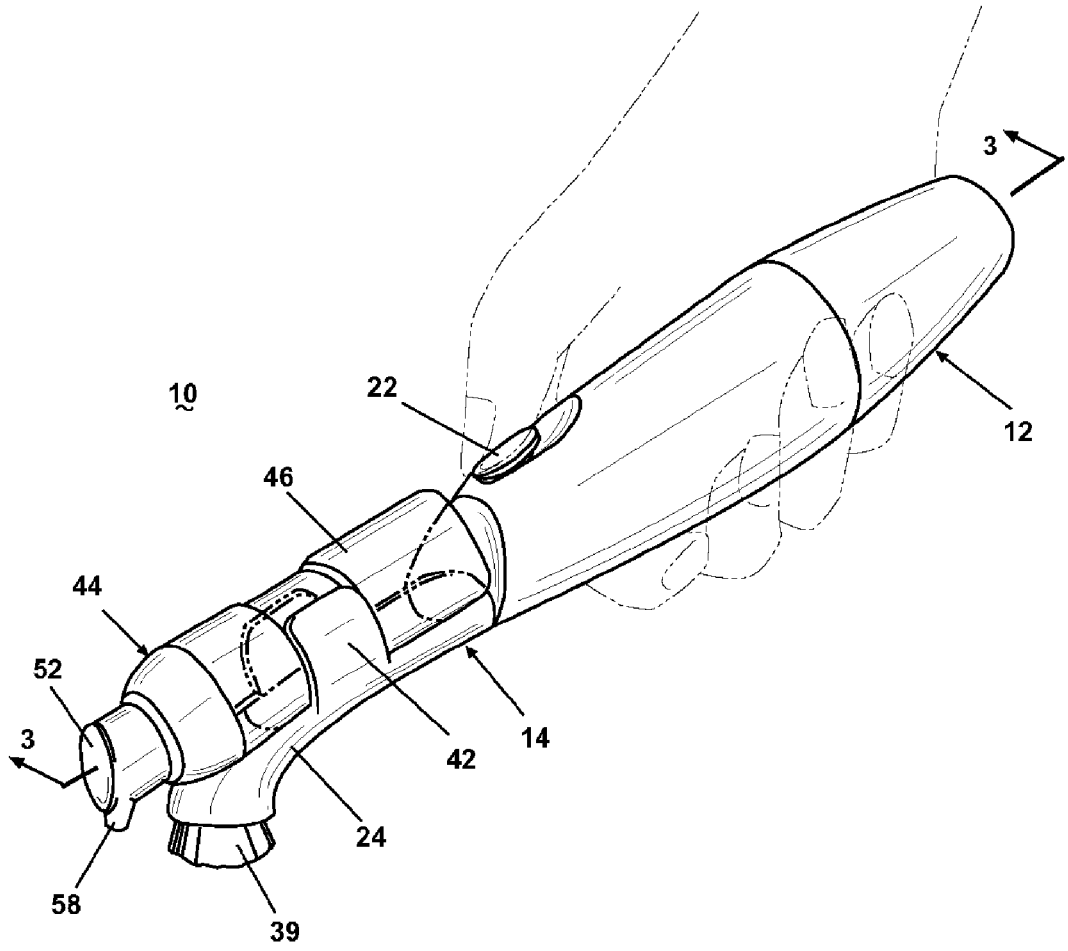
FIG. 1 is a perspective view of a compact carpet spot cleaner according to the invention.
Figure 2:
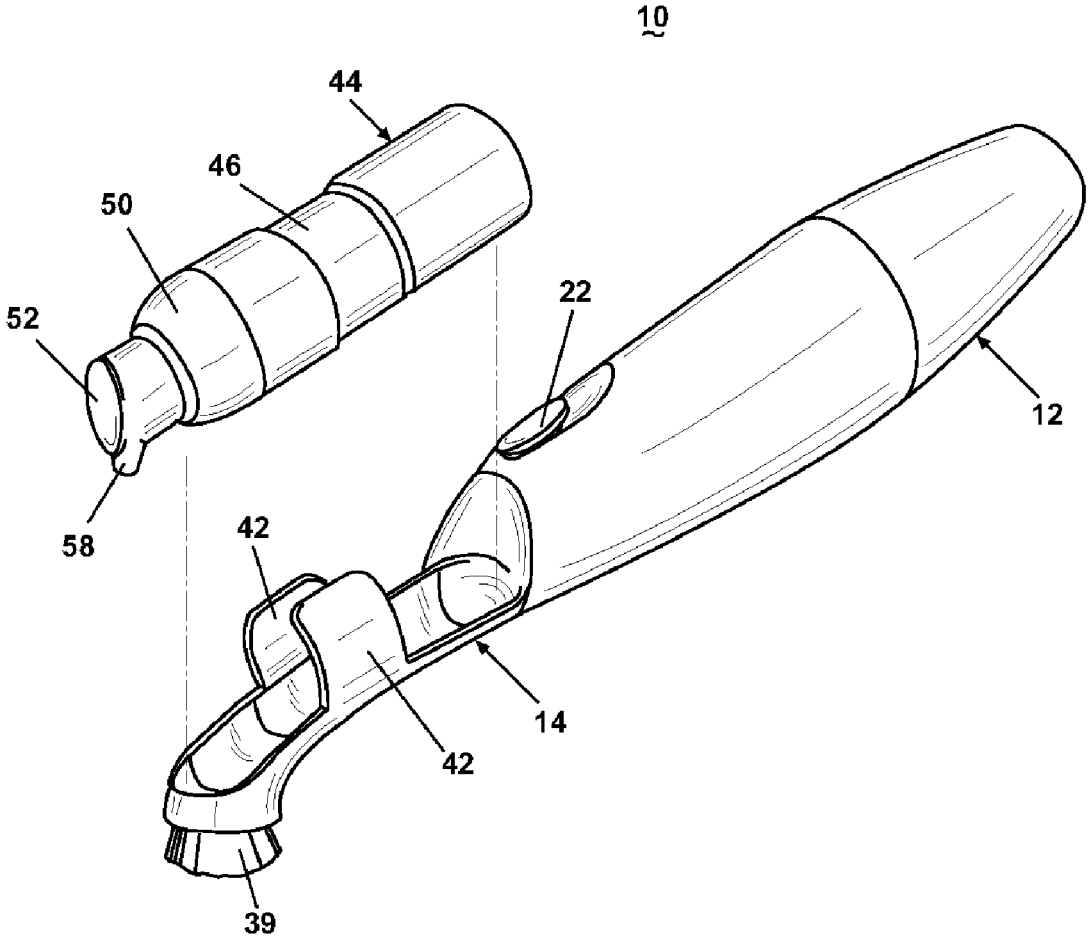
FIG. 2 is an exploded view of the spot cleaner of FIG. 1.
Figure 3:
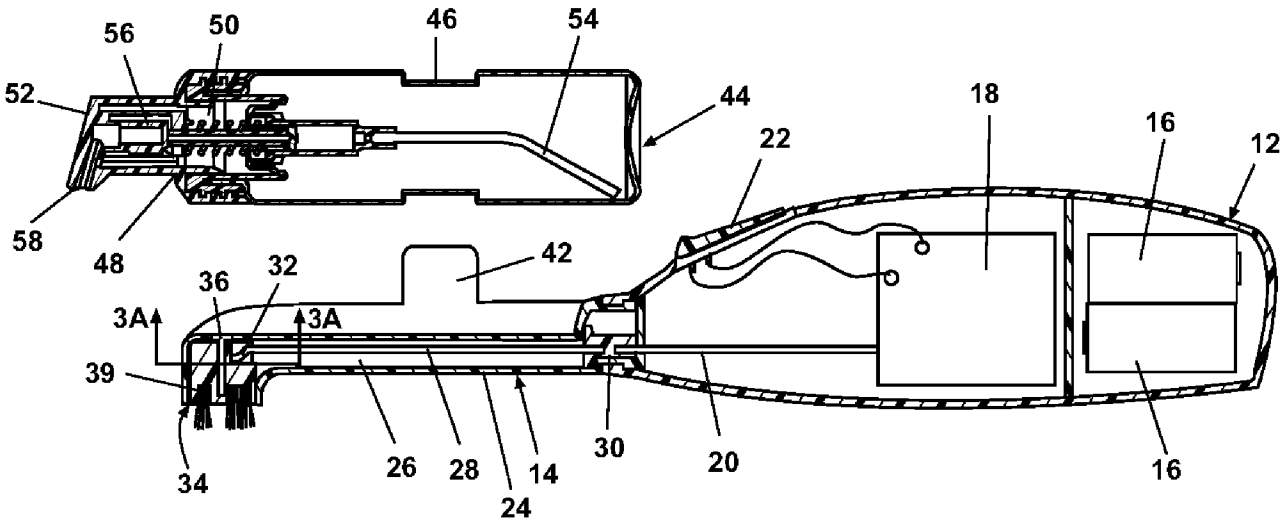
FIG. 3 is a sectional view taken along line 3-3 of FIG. 1.

With reference to FIGS. 1-3, the compact carpet spot cleaner 10 comprises a main housing 12 and a head section 14. As utilized herein to describe this embodiment and other embodiments of the compact carpet spot cleaner according to the invention, the relative terms "proximal" and "distal" refer to portions of the compact carpet spot cleaner that are closer to and farther away from, respectively, a user when the compact carpet spot cleaner 10 is held in a user's hand. For example, the main housing 12 is disposed at the proximal end of the compact carpet spot cleaner 10, and the head section 14 is located at the distal end of the compact carpet spot cleaner 10. The main housing 12 supports at least one battery 16, a motor 18 that has an extended motor shaft 20, and an electrical switch 22. The switch 22 is wired between the batteries 16 and the motor 18 and conveys current from the batteries 16 to the motor 18 upon actuation by a user. When the switch 22 is on, the motor 18 rotates, thereby causing the motor shaft 20 to rotate. The optimum motor shaft 20 rotation is about 6000 RPM, which can be delivered directly from the shaft 20 or can be further controlled by an optional geared transmission assembly (not shown). It will be understood that the motor and its characteristics described herein are by example only as many commercially available motors can be substituted satisfactorily for the motor 18 without departing from the scope of this invention. The main housing 12 is preferably made in mating halves, wherein each half has support ribs that define cavities to securely hold the batteries 16, the motor 18, the motor shaft 20, and the switch 22 in position within the housing 12.

Figure 3A:
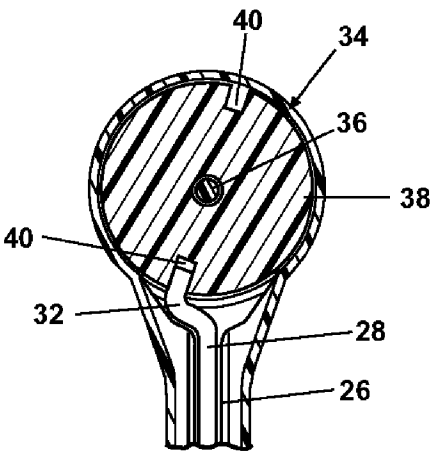
FIG. 3A is a sectional view taken along line 3A-3A of FIG. 3.

Referring to FIGS. 3 and 3A, the head section 14 is selectively removable from the main housing 12 to allow for removal and replacement of alternate head sections 14. The head section 14 comprises a head housing 24 comprising an agitation system having a hollow brush shaft tube 26 through which a brush drive shaft 28 passes. A shaft coupler 30 is enclosed in a proximal end of the head housing 24. The shaft coupler 30 removably mounts the motor shaft 20 to a proximal end of the brush drive shaft 28, maintains longitudinal alignment between the motor shaft 20 and the brush drive shaft 28, and provides a support and bearing surface for the shaft drive mechanism. The distal end of the brush drive shaft 28 forms an offset 32 from the longitudinal axis of the brush drive shaft 28 and the motor shaft 20. A brush assembly 34 is positioned at a distal end of the head section 14. A brush shaft 36 is fixed to a top interior surface of the head section 14 and extends through a brush assembly cavity formed therein. A disk-shaped bristle holder 38 is centrally and rotatably mounted on the brush shaft 36 allowing for relative motion of the bristle holder 38 over the brush shaft 36. The bristle holder 38 further includes at least one slot 40 formed vertically in a perimeter side wall of the bristle holder 38. The bristle holder 38 further comprises a plurality of commonly know flexible bristles 39. The brush shaft offset 32 is captured by slot 40. A suitable brush drive assembly is disclosed in U.S. Pat. No. 5,625,916 to McDougall and is incorporated herein by reference in its entirety.

The head housing 24 is preferably made in mating halves, each half containing support ribs defining a cavity forming the brush shaft tube 26, another cavity forming the brush chamber, and other cavities to securely hold at least the shaft coupler 30 and the bristle holder 38 in position within the housing 24.

As can be appreciated, agitation system can be any commonly known mechanically oscillating, rotating, vibrating, or ultrasonic system. The alternate head sections 14 can incorporate one or more of these systems in varying sizes and are interchangeable with the main housing 12.

A reservoir clip 42 in the form of a plurality of resilient tabs is integrally formed with an upper surface of the head section 14. The reservoir clips 42 conform to the shape of a liquid container assembly 44 to be further described herein. The reservoir clips 42 allow for the liquid container assembly 44 to be removed from the head section 14 for exchange, refilling, or disposal. As can be appreciated, any other commonly known mechanical attachment feature can be used to removably secure the liquid container assembly 44 to the head section 14 or the main housing 12. For example, the liquid container assembly 44 can have a slot that interferingly engages a mating peg on the main housing 12 or the head section 14.

The liquid container assembly 44 comprises a liquid container 46 mounted to a dispenser head 48. The dispenser head 48 further comprises a pump assembly 50. The pump assembly 50 is manually actuated by the user via a pump trigger 52. When the pump assembly 50 is depressed, liquid in the container 46 is drawn through a dip tube 54 and into a valve cup 56. A predetermined amount of air is simultaneously drawn into the valve cup 56 and the air and liquid combine to create a foam that is expelled through a foaming nozzle 58. Spring pressure returns the pump 50 to the ready position when the trigger 52 is released. A suitable foaming pump dispenser is disclosed in U.S. Pat. No. 6,612,468 to Pritchett et al. and is incorporated by reference herein in its entirety. However, other commonly known manual pumps can also be incorporated.

Figure 4:
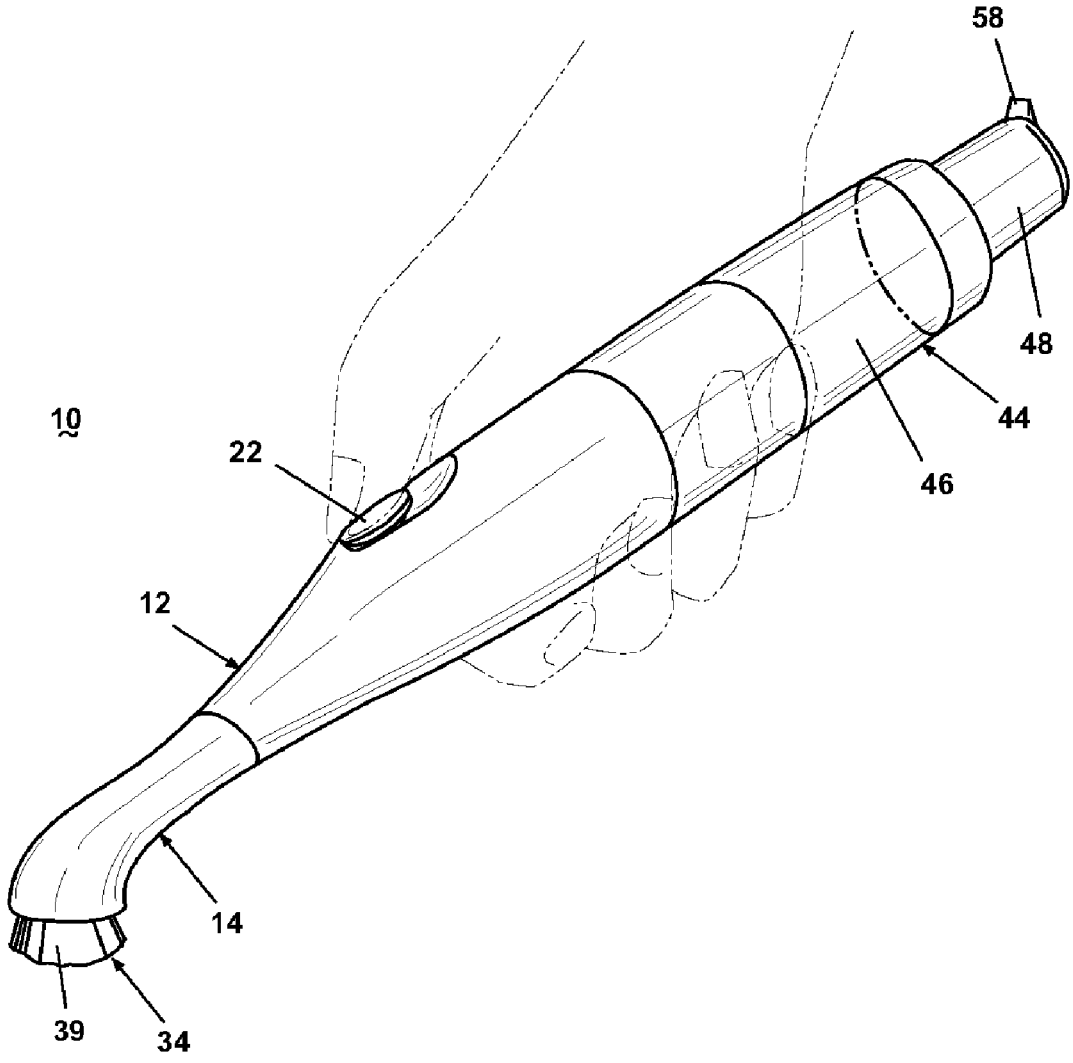
FIG. 4 is a second embodiment of a compact carpet spot cleaner with a liquid cleaner dispenser at a proximal end thereof.

Referring to FIG. 4, in an alternate embodiment, the liquid container assembly 44 is positioned at a location remote from head section 14.

The liquid container assembly 144 preferably stores and dispenses an aqueous cleaning composition. While the cleaning composition can be any suitable aqueous cleaning composition, the cleaning composition preferably comprises a solvent, a soil resist, one or more surfactants, and, optionally, a stabilizer or pH controller, an oxidizing agent, and a fragrance. The solvent is preferably water but can also include organic solvents, such as 2-butoxy ethanol. The preferred concentration range of the solvent is about 60.0 to 99.0 percent by weight (wt. %).

The soil resist is preferably a polymer or copolymer and is preferably present from about 0.1 to 6.0 wt. %. Suitable polymeric or copolymeric soil resists include, but are not limited to, polymers derived from monomers of acrylic acid, methacrylic acid, methacrylate, methol-methacrylate, and maleicacid, as well as copolymers derived from these monomers and olefin. Exemplary commercial acrylic copolymer soil resists include Syntran 4022 and Syntran 4020, which are available from Interpolymer Corporation.

Suitable surfactants include anionic, cationic, nonionic, and zwitterionic surfactants, which are well known in the art. Preferred surfactants of the present invention include anionic surfactants, nonionic surfactants, or combinations thereof. Exemplary surfactants include, but are not limited to, triethanolamine lauroyl sulfate, sodium lauroyl sulfate, sodium C14-16 olefin sulfanate, ethoxylated alcohols, and amine oxides. The surfactant can also be a blend of a nonionic surfactant and a cationic surfactant, an example of which is Berol 226 SA, available from Akzo Nobel. Preferably, the concentration of each of the surfactants is in a range of about 0.01 to 6.0 wt. %.

The pH of the cleaning composition can be adjusted within a preferred range by the addition of a stabilizer or a pH controller. When the cleaning composition comprises the oxidizing agent, the preferred pH range is from about 5.0 to 7.0, and the pH is preferably about 5.5. Controlling the composition of stabilizer/pH controller is important to prevent grading of the oxidizing agent. When the cleaning composition does not include the oxidizing agent, the pH is preferably above about 8.0. The stabilizer/pH controller is preferably present in an amount of about between 0.1 to 6.0 wt. %. Exemplary stabilizer/pH controllers include, but are not limited to, diethylenetriaminepentaacetic acid and carbonates, such as sodium carbonate.

When the cleaning composition comprises the oxidizing agent, the oxidizing agent is preferably a peroxygen compound present in a range of about 1.0 to 9.0 wt. %. Most preferably, the concentration of the oxidizing agent is about 5.00 wt. %. The preferred peroxygen compound is hydrogen peroxide. It is known in the cleaning composition art to use an industrial grade hydrogen peroxide in the formation of cleaning products.

Three examples, Compositions A-C, of cleaning compositions having the oxidizing agent are presented below. These cleaning compositions are shown for exemplary purposes only and are not meant to limit the invention in any manner.

Example

Composition A

Composition A, which is especially effective in the removal of water and protein stains, is formed with the following ingredients in amounts expressed as percent by weight of the total weight of the composition:

| INGREDIENT | TYPE OF INGREDIENT | WT. % ACTIVE | PREFERRED RANGE |
|---|---|---|---|
| Water | Solvent | 93.00 | 60.00-99.00% |
| Interpolymer 4022 | Soil Resist | 0.60 | 0.10-6.00% |
| Triethanolamine Lauroyl Sulfate | Surfactant | 0.08 | 0.01-6.00% |
| Sodium Lauroyl Sulfate | Surfactant | 0.52 | 0.10-6.00% |
| Sodium C14-16 Olefin | Surfactant | 0.55 | 0.10-6.00% |
| Diethylenetriaminepentaacetic Acid | Stabilizer/pH Controller | 0.25 | 0.10-6.00% |
| Hydrogen Peroxide | Oxidizing Agent | 5.00 | 1.00-9.00% |

Example

Composition B

Composition B, which is especially suitable for removing oil and grease stains, is similar in formulation to Composition A. However, the concentration of the water is preferably about 92.95 wt. % (within a range of about 60.00 to 99.00 wt. %). Furthermore, the preferred surfactant for Composition B is Berol 226 SA, which is present at about 1.20 wt. % (within a range of about 0.10 to 6.00 wt. %).

Example

Composition C

Composition C, which is especially effective in the removal of oil and grease stains, is formed with the following ingredients in amounts expressed as percent by weight of the total weight of the composition:

| INGREDIENT | TYPE OF INGREDIENT | WT. % ACTIVE | PREFERRED RANGE |
|---|---|---|---|
| Water | Solvent | 92.95 | 60.00-99.00% |
| Interpolymer 4022 | Soil Resist | 0.60 | 0.10-6.00% |
| Ethoxylated Alcohol | Surfactant | 1.20 | 0.01-6.00% |
| Diethylenetriaminepentaacetic Acid | Stabilizer/pH Controller | 0.25 | 0.10-6.00% |
| Hydrogen Peroxide | Oxidizing Agent | 5.00 | 1.00-9.00% |

Optionally, the liquid container assembly 44 can store and dispense a cleaning composition without the oxidizing agent, and a separate, auxiliary liquid container assembly (not shown) that stores and dispenses an oxidizing composition can be used with the compact carpet spot cleaner 10 when the assistance of the oxidizing composition is desired. An example of a cleaning composition without an oxidizing agent is presented in the following table as Composition D.

Example

Composition D

| INGREDIENT | TYPE OF INGREDIENT | PREFERRED WT. % |
|---|---|---|
| Water | Solvent | 91.40 |
| Syntran 4020 | Soil Resist | 3.00 |
| Sodium Carbonate | Stabilizer/pH Controller | 0.20 |
| Fatty Amine Oxide | Surfactant | 1.70 |
| Ethoxylated Alcohol | Surfactant | 0.60 |
| Oasis 446064 | Fragrance | 0.10 |
| 2-Butoxy Ethanol | Solvent | 3.00 |

An exemplary oxidizing composition for the auxiliary liquid container assembly is presented in the following table as Composition E. The oxidizing composition preferably includes a chelating agent, such as diethylenetriaminepentaacetic acid, to collect metal ions and thereby protect the oxidizing agent from a catalytic decomposition that can be induced by metal ions.

Example

Composition E

| INGREDIENT | TYPE OF INGREDIENT | PREFERRED WT. % |
|---|---|---|
| Water | Solvent | 88.32 |
| Diethylenetriaminepentaacetic Acid (DTPA) | Chelating Agent | 0.25 |
| Hydrogen Peroxide-35% | Oxidizing Agent | 11.43 |

Testing was performed at a laboratory to demonstrate the ability of the compositions to remove stains commonly found in rugs and carpets. Cut pile nylon carpet was used for test purposes. The stains were uniformly applied in a one quarter inch diameter ring. The cleaning procedure was initiated after a one hour dwell period. The stain removal procedure was as follows:

1. The stain was blotted repeatedly using weighted paper towels until no transfer occurred.
2. Seven grams of cleaning agent were applied to the stain for a period of approximately one minute.
3. The compact carpet spot cleaner was used to agitate the stain for between 3 and 10 seconds.
4. The stain was blotted using paper towels.
5. Test material (cut pile nylon carpet) was allowed to dry at ambient temperature.
6. A panel of technicians assessed the appearance of the stain.
7. Results of this study are set forth in Table 1.

TABLE 1

| Staining Agent | Comp A | Comp B |
|---|---|---|
| Grape Juice | Removed | |
| Spaghetti Sauce | | Removed |

Results of this cleaning study indicate the effectiveness of this invention in removing both water/protein stains and oil/grease stains.

In operation, the compact carpet spot cleaner 10 is fitted with an energized battery 16 in the main housing 12. The liquid container assembly 44 is removed from the cleaner 10. The dispenser head 48 is removed from the liquid container 46. The liquid container 46 is filled with a suitable amount of a cleaning composition, such as any of Compositions A-D. The dispenser head 48 is replaced on the liquid container 46 to form a leak-proof seal. The filled liquid container assembly 44 is replaced on the head section 14 within the reservoir clips 42. The user carries the charged and filled compact carpet spot cleaner 10 to the spot to be cleaned, positions the cleaner 10 over the spot, and presses the trigger 52 on the pump assembly 50. As the pump assembly 50 is depressed, the composition is drawn from the liquid container 46, through the dip tube 54, and into the valve cup 56. Air is also drawn into the valve cup 56, where it mixes with the composition to create a foam. The foamy composition is expelled through the dispenser head 48 through the nozzle 58. The foam composition is allowed to set on the stain for a suitable period.

Once the foam composition is applied, the user actuates the switch 22 to apply power to the motor 18. The motor 18 rotates, thereby causing the motor shaft 20 to rotate. The motor shaft 20 is connected to the brush drive shaft 28 through the shaft coupler 30. As the drive shaft 28 rotates, the brush drive shaft offset 32 rotates and slides up and down within the slot 40 on the bristle holder 38. As a result, the bristle holder 38 rotates back and forth about the brush holder shaft 36 in an oscillating motion.

A third embodiment of a compact carpet spot cleaner 110 according to the invention is illustrated in FIGS. 5-13. As shown in FIGS. 5-8, the third embodiment of the cleaner 110 comprises a main housing 112 and a liquid container assembly 144 removably mounted to the main housing 112. The main housing 112 comprises a battery housing 160, an upper housing 162, and a lower housing 164, which together form a rear gripping handle portion 113 and a forward head portion 114. The upper housing 162 and the lower housing 164 mate to form a motor chamber 166 in the rear portion 113 and an elongated head chamber 168 in the head portion 114. The upper housing 162 and the lower housing 164 further include several members for holding various components inside the motor chamber 166 and the head chamber 168. The lower housing 164 includes a generally rectangular cleaning head support 170 at its distal end for removably mounting a cleaning head assembly 134 to the head portion 114. The battery housing 160 stores suitable and preferably lightweight and compact batteries 116, such as two AA batteries. The battery housing 160 can be removed from the main housing 112 to replace the batteries 116, if necessary. Preferably, the battery housing 160 snap fits onto the upper and lower housings 162 and 164 in a conventional fashion.

The remainder of the description of the compact carpet spot cleaner 110 employs the relative terms "proximal," "distal," rearward," "forward," and variations thereof. "Proximal" and "rearward" refer to a direction closer to a user when a user holds the rear portion 113 of the compact carpet spot cleaner 110 in a hand with the head portion 114 pointing away from the user. "Distal" and "forward" refer to a direction farther away from the user when the user holds the compact carpet spot cleaner 110 in the manner just described. These terms are utilized to aid in describing the compact carpet spot cleaner 110 and are not intended to limit the invention in any manner.

Figure 9A:
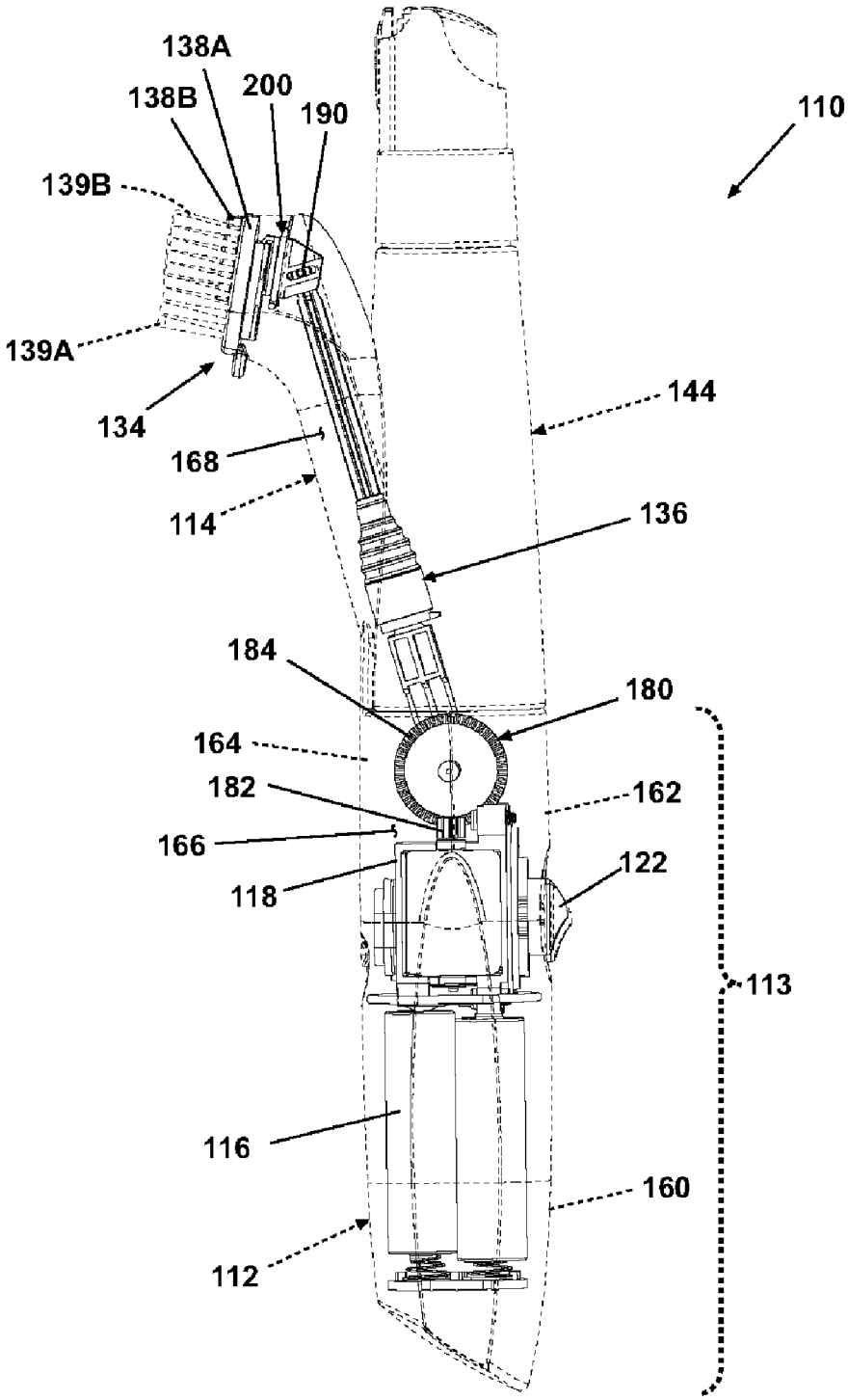
FIG. 9A is a side view of the compact carpet spot cleaner of FIG. 5 with the cleaning head assembly in a first position and the main housing, the liquid container assembly, and bristles on the cleaning head assembly shown in phantom.
Figure 9B:
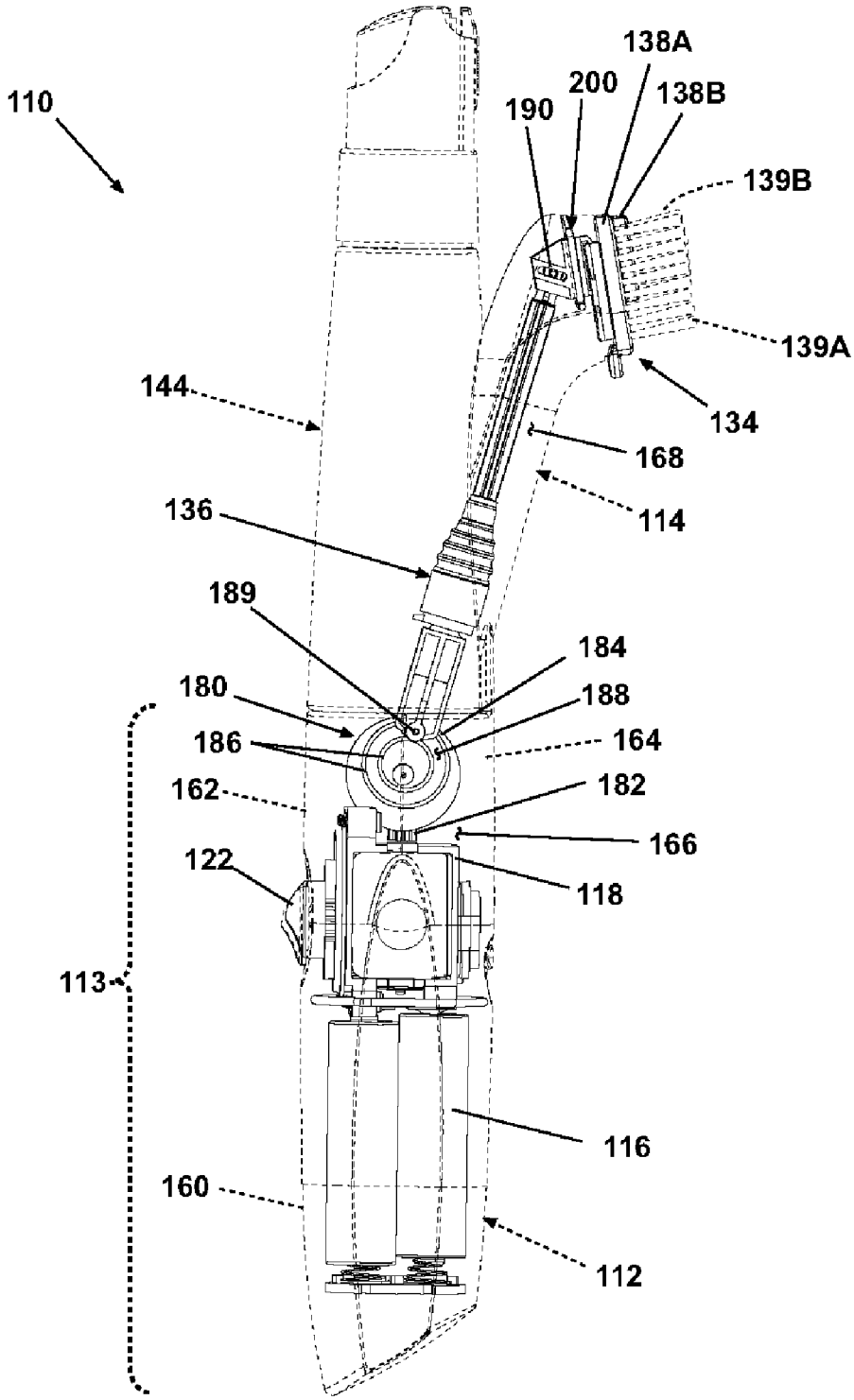
FIG. 9B is a side view similar to FIG. 9A with the compact carpet spot cleaner rotated 180 degrees about its longitudinal axis.
Figure 9C:
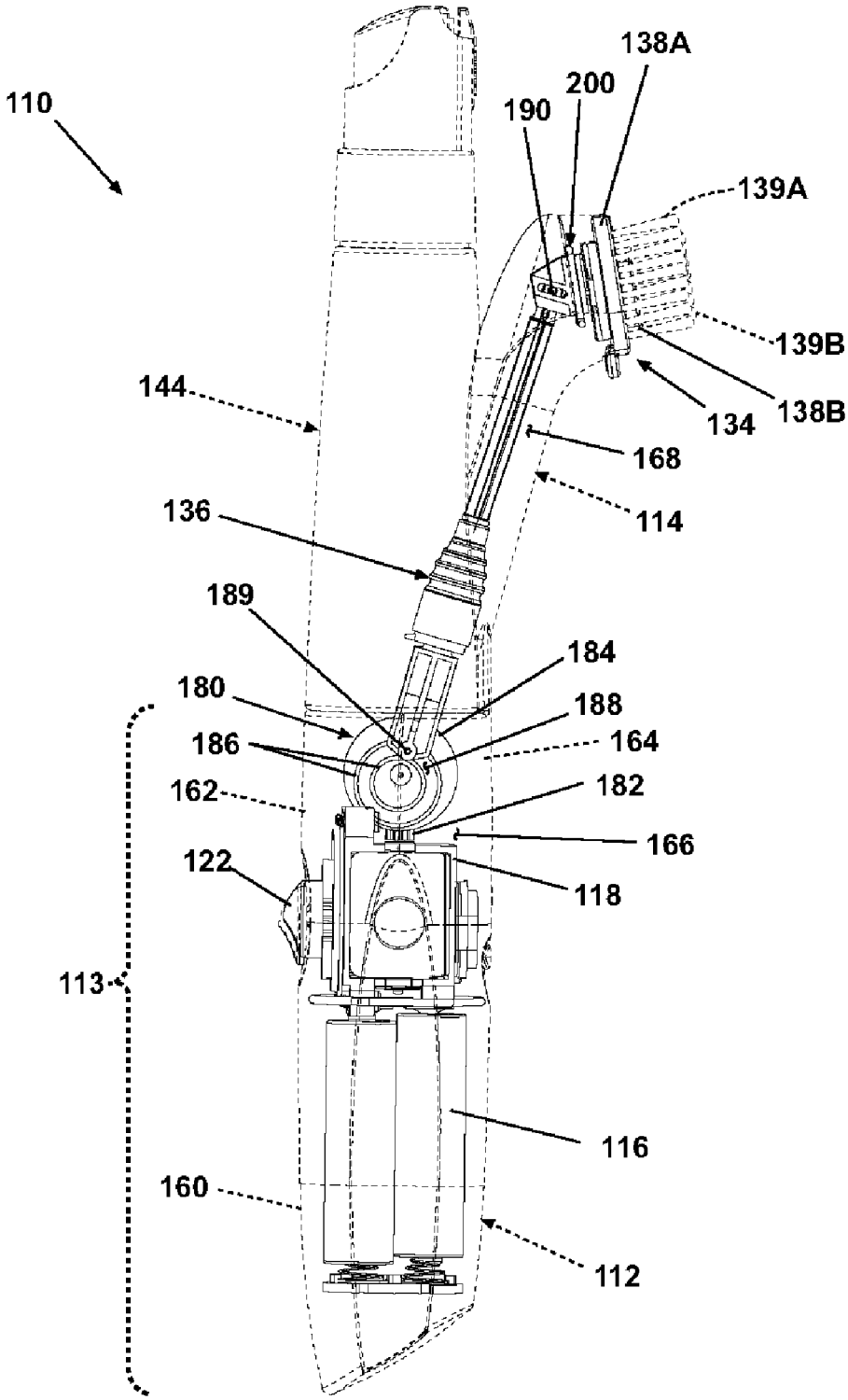
FIG. 9C is a side view similar to FIG. 9B with the cleaning head assembly in a second position.

Referring now to FIGS. 9A-9C, the motor chamber 166 houses a motor 118 operatively coupled to a gear assembly 180. The motor 118 is powered by the batteries 116 through a conventional connection between the battery housing 160 and the upper and lower housings 162 and 164. A switch 122 operatively connected to the batteries 116 and the motor 118 controls power to the motor 118. Preferably, the switch 122 is located on the rear portion 113 such that a user can actuate the switch 122 with a thumb while holding the rear portion 113 in a hand. The motor 118 comprises a motor shaft (not numbered) with a drive gear 182 at its distal end. The drive gear 182 rotates at a predetermined rate when power is supplied to the motor 118 and mechanically couples the motor shaft to a circular follower gear 184 of the gear assembly 180. The follower gear 184 comprises a plurality of teeth on one side to mesh with the drive gear 182. Two concentric circular guides 186 extend laterally from the other side of the follower gear 184 and define a circular path 188 therebetween. The circular center of the guides 186 and the path 188 is offset from the circular center of the follower gear 184. Rotation of the motor shaft and thereby the drive gear 182 induces rotation of the follower gear 184 about its circular center.

Figure 10A:
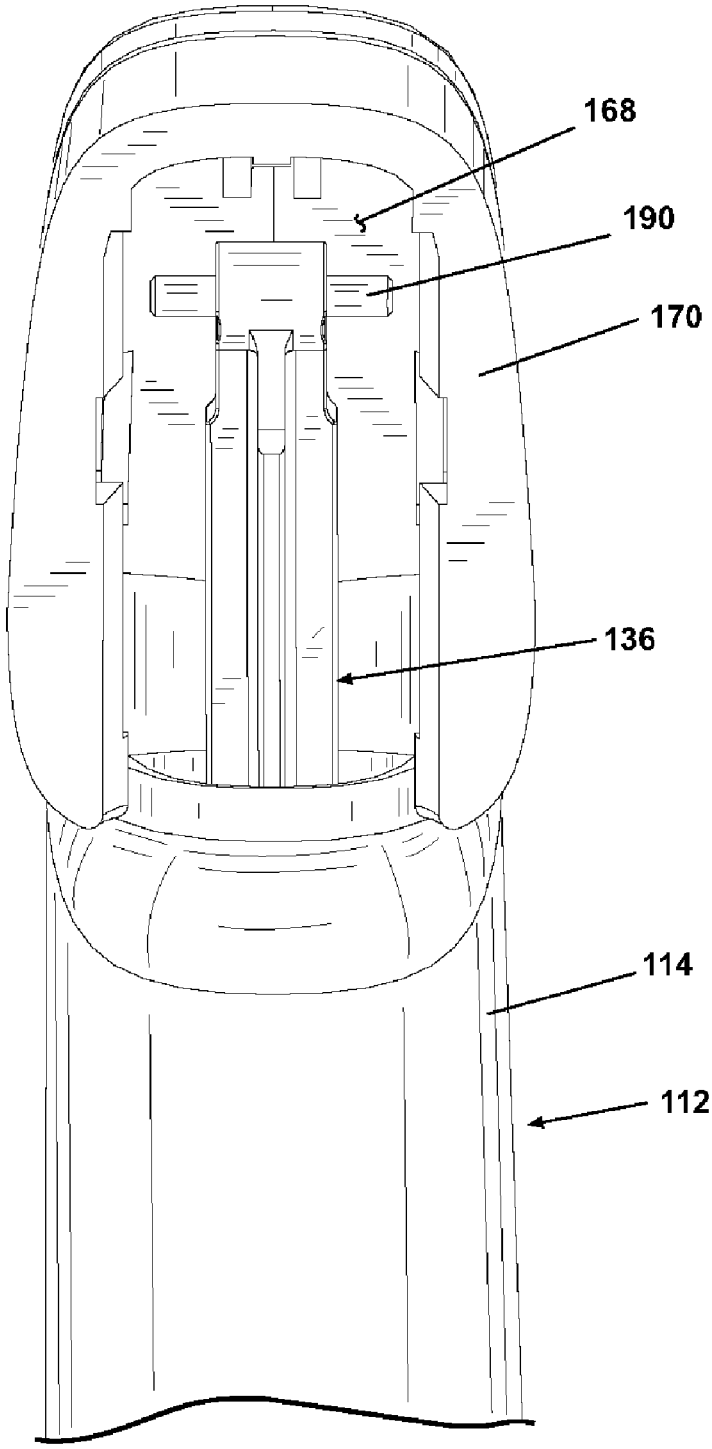
FIG. 10A is a front view of a cleaning head holder shaft and a rod on the cleaning head holder shaft positioned within the main housing of the compact carpet spot cleaner of FIG. 7.
Figure 10B:
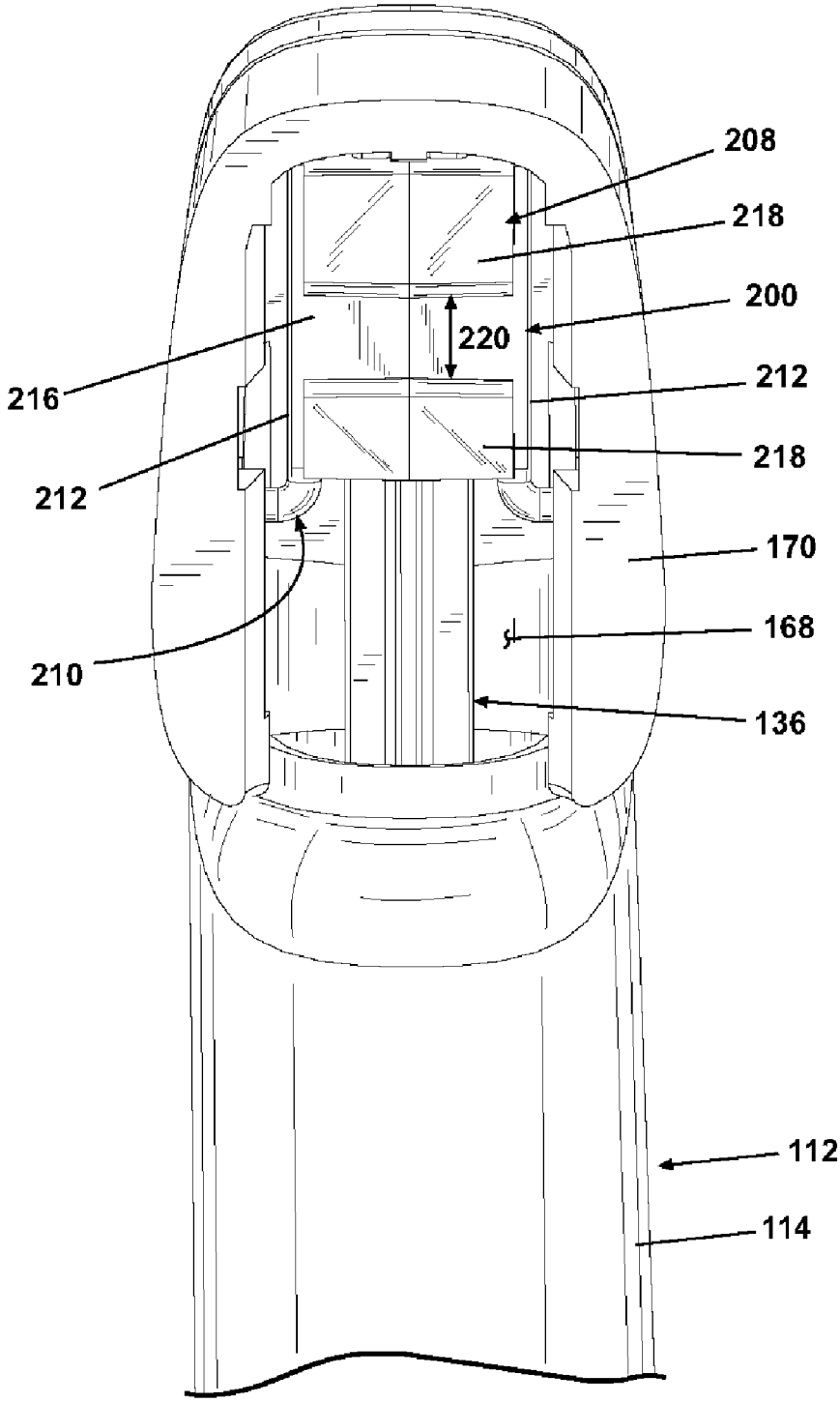
FIG. 10B is a front view similar to FIG. 10A with a cleaning head holder mounted onto the rod.
Figure 10C:
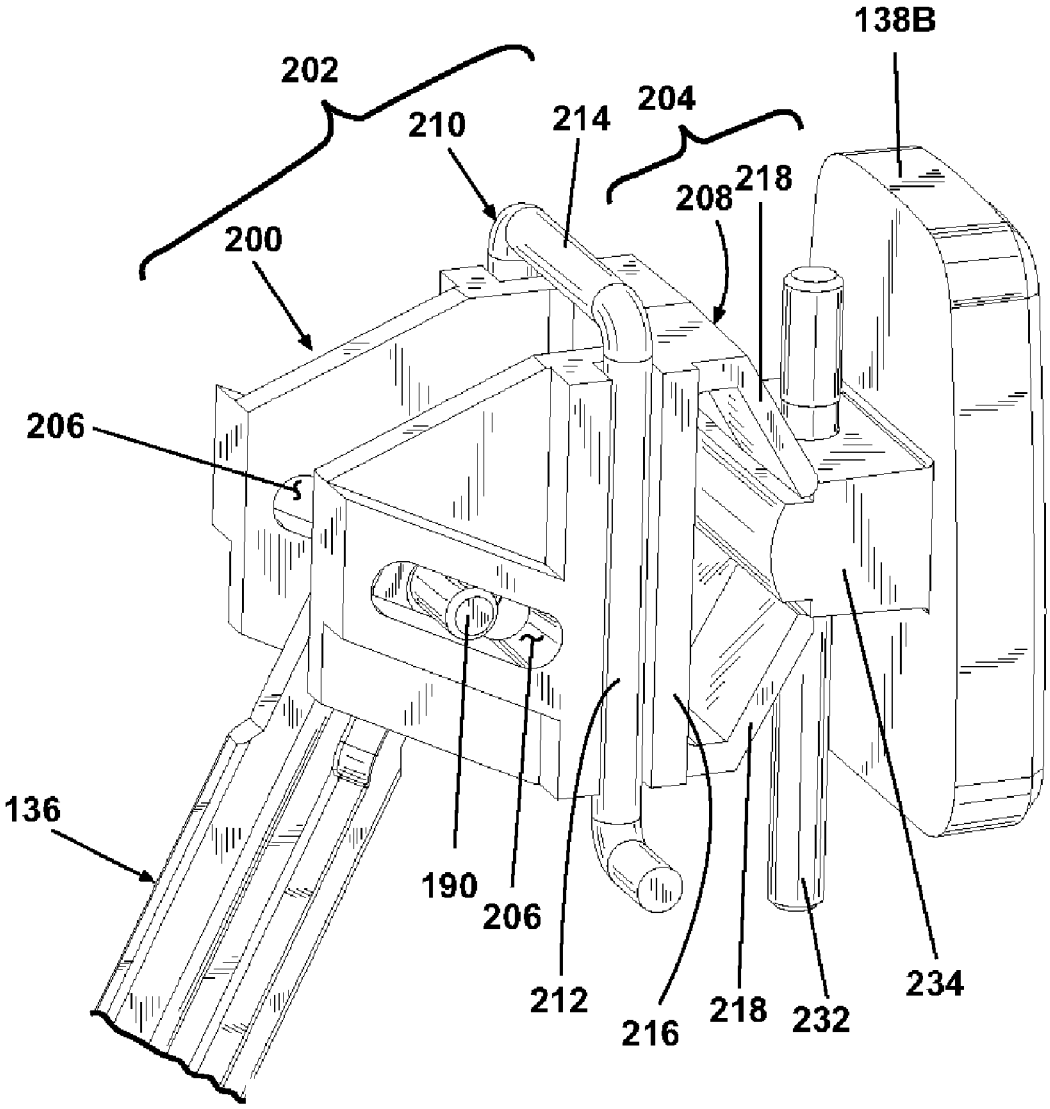
FIG. 10C is a perspective view of the cleaning head holder shaft, the rod, and the cleaning head holder of FIGS. 10A and 10B, wherein a portion of the cleaning head assembly is mounted to the cleaning head holder.

With additional reference to FIGS. 10A-10C, a cleaning head holder shaft 136 resides primarily within the head chamber 168 and operatively communicates the gear assembly 180 with a cleaning head holder 200. The cleaning head holder 200 resides in the distal end of the head chamber 168 and is removably coupled to the cleaning head assembly 134. The proximal end of the cleaning head holder shaft 136 is slidably mounted within the path 188 by means of a pin 189 such that the follower gear 184 can rotate relative to the cleaning head holder shaft 136. The distal end of the cleaning head holder shaft 136 includes a rod 190, oriented substantially perpendicular to the cleaning head holder shaft 136 for connection to the cleaning head holder 200.

Figure 11:
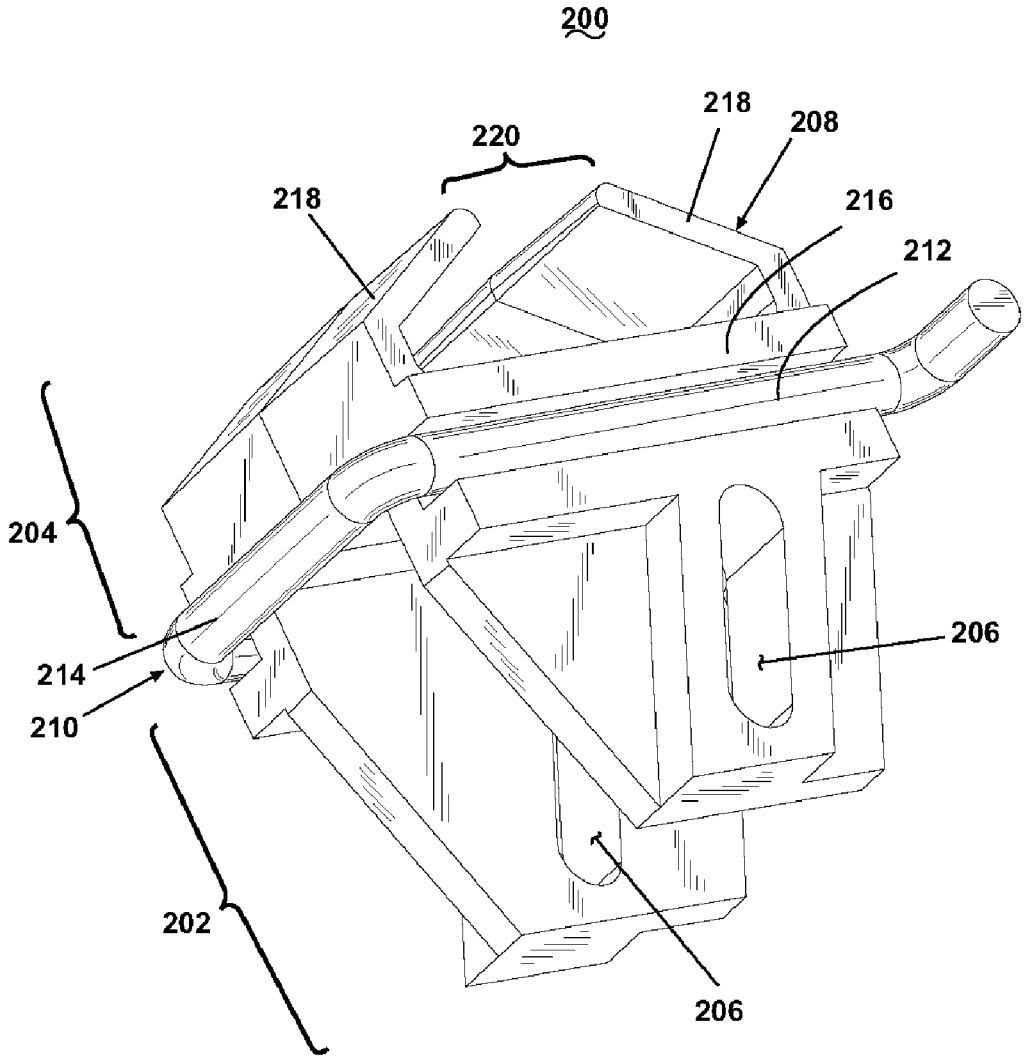
FIG. 11 is a perspective view of the cleaning head holder of FIG. 10C.
Figure 12A:
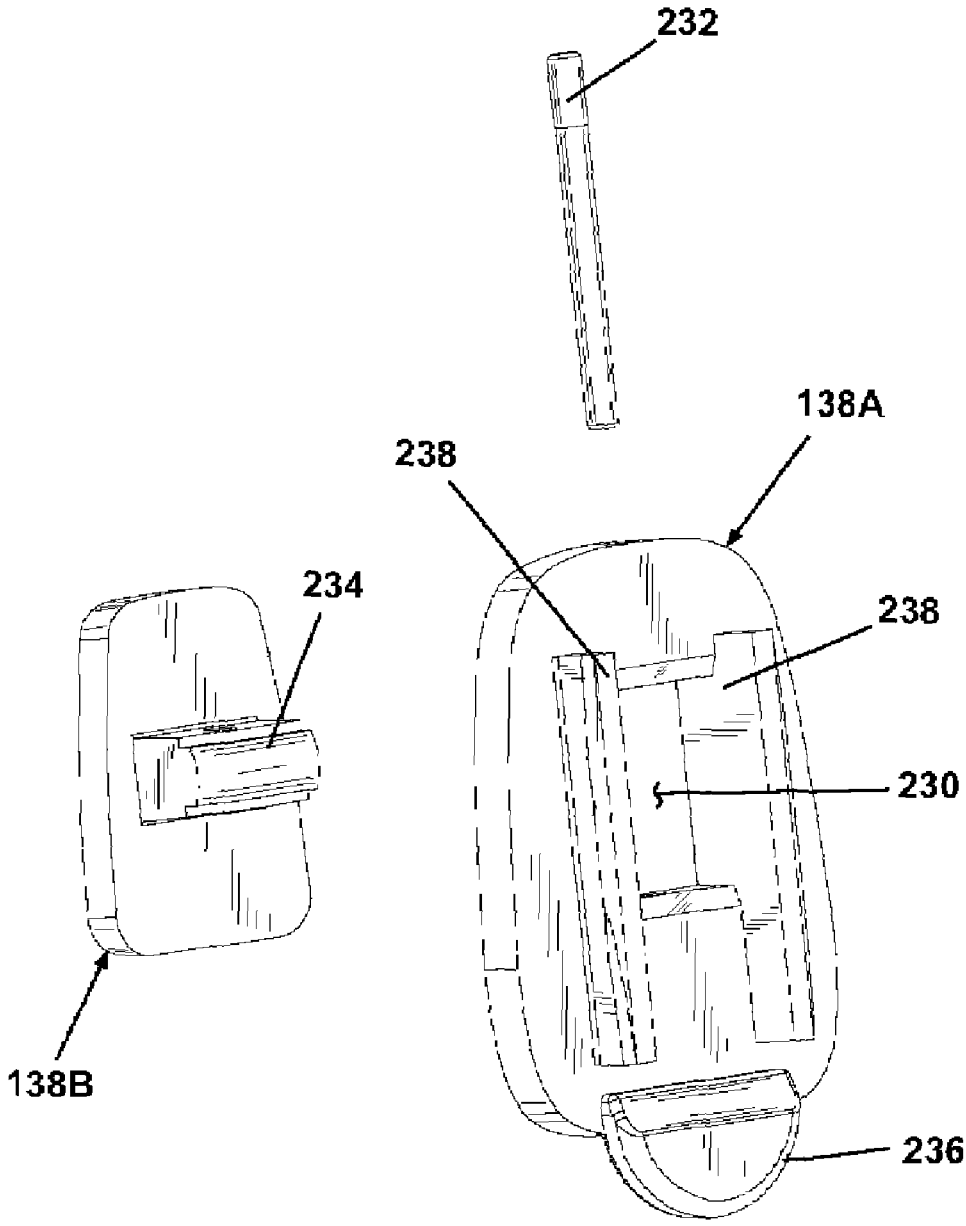
FIG. 12A is an exploded view of the cleaning head assembly of FIG. 5.
Figure 12B:
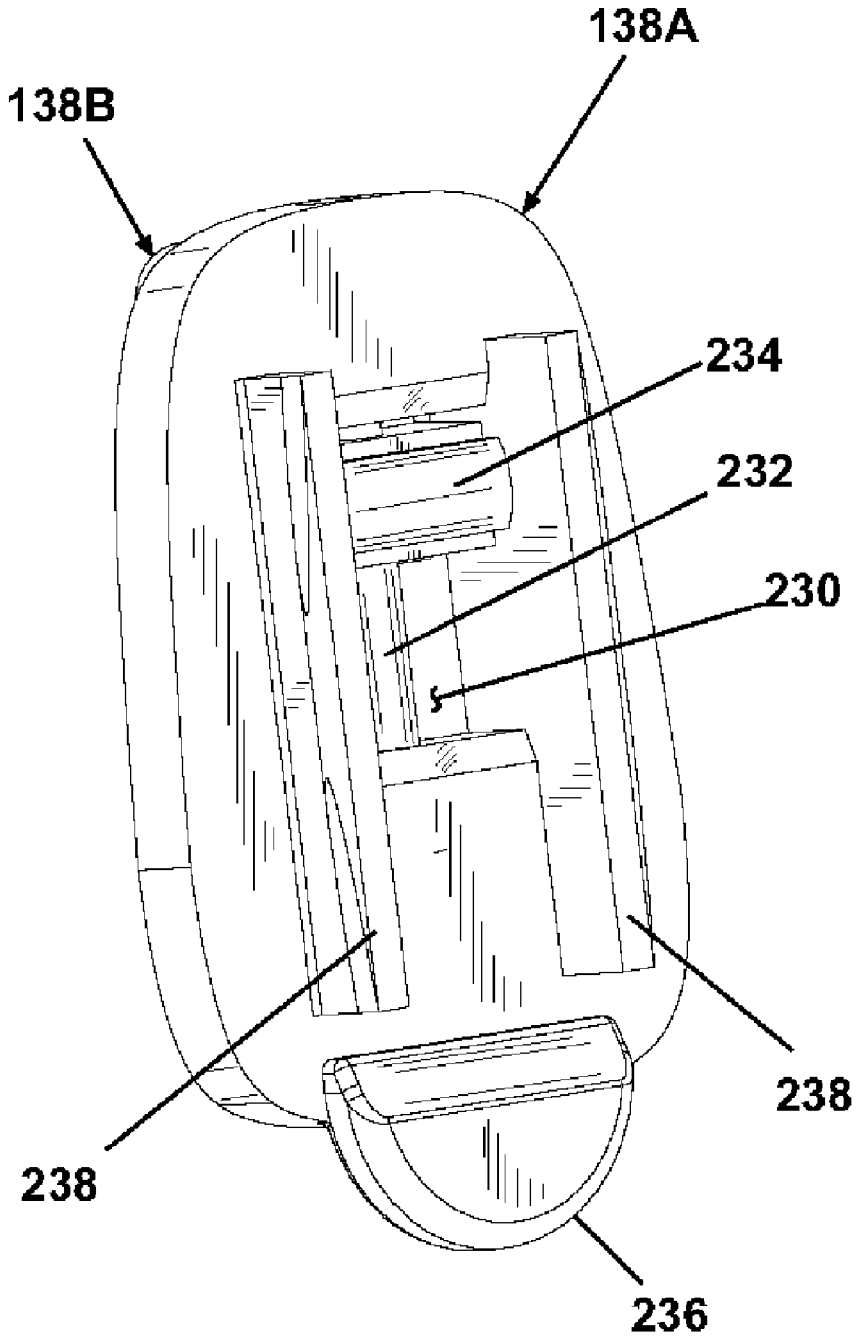
FIG. 12B is a perspective view of the cleaning head assembly of FIG. 12A.

As best viewed in FIGS. 10C and 11, the cleaning head holder 200 comprises a first portion 202 and a second portion 204. The first portion 202 forms a pair of angled apertures 206 sized to slidably receive the rod 190. The second portion 204 includes a cleaning head assembly guide 208 that is removably coupled with the cleaning head assembly 134. The cleaning head assembly guide 208 comprises a generally flat base 216 and two arms 218 that extend away from the base 216 and towards each other to define an opening 220 therebetween. A U-shaped bracket 210 having parallel legs 212 joined by a bight portion 214 surrounds the cleaning head holder 200 between the first and second portions 202 and 204. The legs 212 are longer than the cleaning head holder 200 such that the cleaning head holder 200 can slide on the bracket 210 towards and away from the bight portion 214. The bracket 210 is fixedly mounted to the upper housing 162 to mount the cleaning head holder 200 within the head chamber 168. Consequently, the cleaning head holder 20 can slide forwardly and rearwardly within the head chamber 168 along the bracket 210.

Referring now to FIGS. 9B, 9C, 10C, 12A, 12B, and 13, the cleaning head assembly 134 comprises a bristle holder 138A that mounts a plurality of first bristles 139A, which are preferably long and flexible, in a U-shaped pattern. The bristle holder 138A further comprises a central aperture 230 and a shaft 232 that extends along the length of the aperture 230. The shaft 232 slidably supports an auxiliary bristle holder 138B that mounts a plurality of second bristles 139B, which are preferably short and rigid compared to the first bristles 139A and are surrounded on three sides by the first bristles 139A. The auxiliary bristle holder 138B includes a rear flange 234 that is slidably mounted on the shaft 232 within the aperture 230. The auxiliary bristle holder 138B can slide along the shaft 232 from a first position shown in FIG. 9B to a second position shown in FIG. 9C to move the second bristles 139B relative to the first bristles 139A and the bristle holder 138A. The cleaning head assembly 134 further comprises a tab 236 that extends from the bristle holder 138A and a pair of elongated projections 238 disposed on the bristle holder 138A on the side opposite the first bristles 139A.

The cleaning head assembly 134 is removably attached to the head portion 114 of the main housing 112. The projections 238 on the bristle holder 138A are received within the cleaning head support 170 to form a friction fit therewith to retain the cleaning head assembly 134 on the lower housing 164. When the cleaning head assembly 134 is mounted to the head portion 114, the flange 243 on the auxiliary bristle holder 138B is held between the guide arms 218 on the cleaning head holder 200, as shown in FIG. 10C. To mount the cleaning head assembly 134 to the head portion 114, the flange 243 is aligned with the opening 220 between the guide arms 218, and the projections 238 are aligned with the cleaning head support 170. The cleaning head assembly 134 is then pushed onto the lower housing 164 such that the flange 243 is received within the opening 220, and the projections 238 abut the cleaning head support 170 in juxtaposition. To remove the cleaning head assembly 134, the auxiliary bristle holder 139B is slid along the shaft 232 and oriented such that the flange 243 is aligned with the opening 220, and the cleaning head assembly 134 is pulled from the lower housing 164, for example, by pulling on the tab 236.

Figure 6:
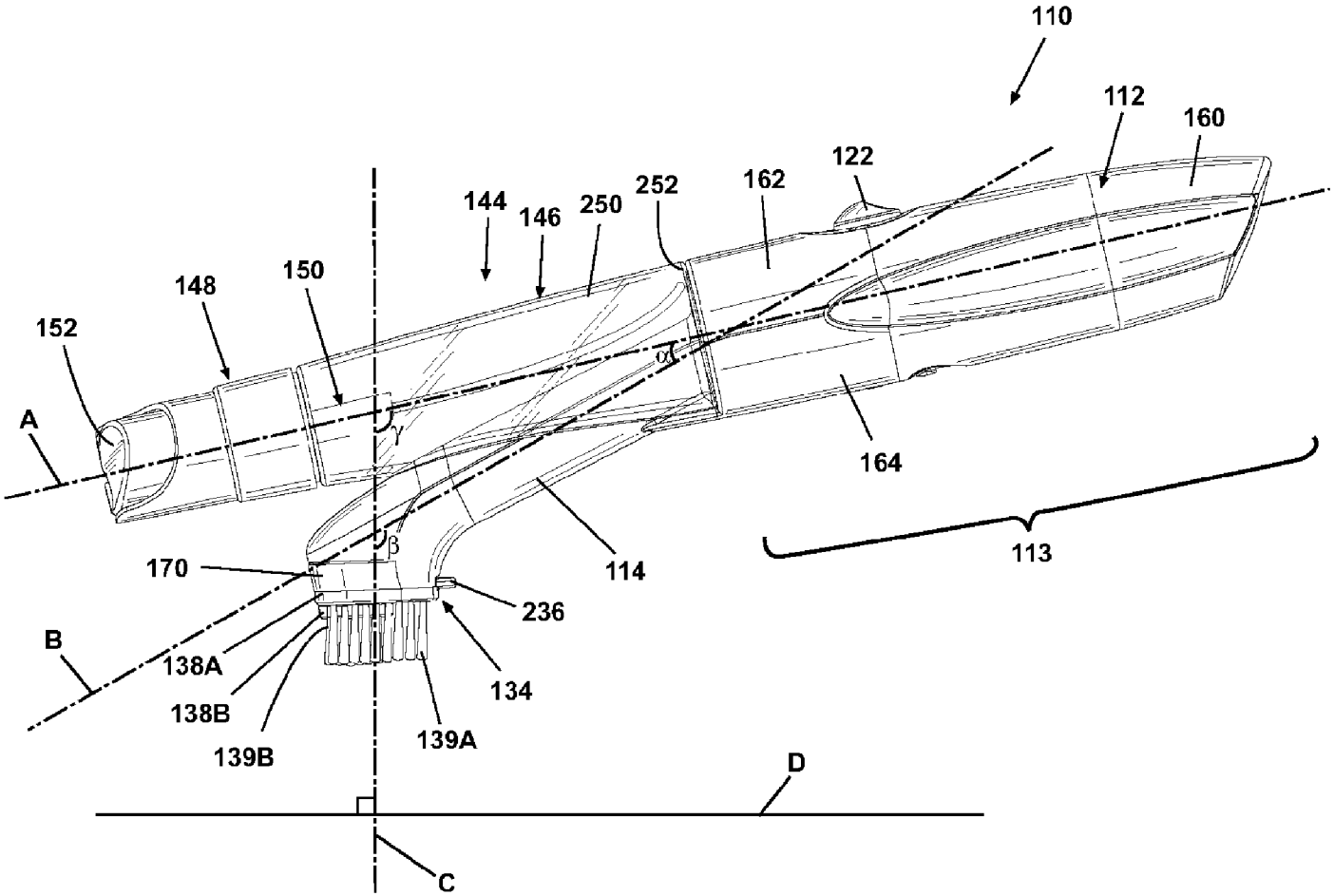
FIG. 6 is a side view of the compact carpet spot cleaner of FIG. 5.

Referring again to FIG. 6, the relative orientations of the rear and head portions 113, 114 of the main housing 112 and the cleaning head assembly 134 are designed so that a user can comfortably and ergonomically hold and apply a downward force to the compact carpet spot cleaner 110 while removing a spot or stain from a surface to be cleaned D. The rear portion 113 has a longitudinal axis A that extends generally along a centerline of the rear portion 113 or parallel to the centerline, wherein the centerline is coincident with a geometrical center of a radial cross-section of the rear portion 113. Similarly, the head portion 114 has a longitudinal axis B that extends generally along or parallel to a centerline thereof. As shown in FIG. 6, a forward portion of the longitudinal axis B is oriented at an acute angle $\alpha$ relative to a forward portion of the longitudinal axis A. Preferably, the angle $\alpha$ is in a range of about 10 degrees to about 30 degrees and is most preferably about 20 degrees. Furthermore, the bristles 139A, 139B extend along an axis C that is generally perpendicular to the bristle holder 138A, and the axis C is oriented at an obtuse angle $\beta$ relative to the rear portion of the longitudinal axis B. Preferably, the angle $\beta$ is in a range of about 110 degrees to about 130 degrees and is most preferably about 120 degrees. During use, the bristles 139A, 139B are preferably oriented generally perpendicular to the surface to be cleaned D, and, because of the above described relative orientations, the handle portion of the longitudinal axis A is oriented at an obtuse angle $\gamma$ relative to a plane perpendicular to the surface to be cleaned D. Consequently, the rear portion 113 of the main housing 112 is oriented upward relative to the surface to be cleaned so that the user can easily and comfortably apply a downward force to the cleaning head assembly 134 of the compact carpet spot cleaner 110. The obtuse angle $\gamma$ equals the difference between the angles $\beta$ and $\alpha$; thus, for the angle $\gamma$ to be obtuse, the angles $\alpha$ and $\beta$ are selected so that their difference is greater than 90 degrees. When the angles $\alpha$ and $\beta$ equal the preferred angles of about 20 and 120 degrees, respectively, the angle $\gamma$ equals about 100 degrees. The angle $\gamma$ can vary over a range generally of 95-120 degrees but is preferably about 100 degrees.

Figure 7:
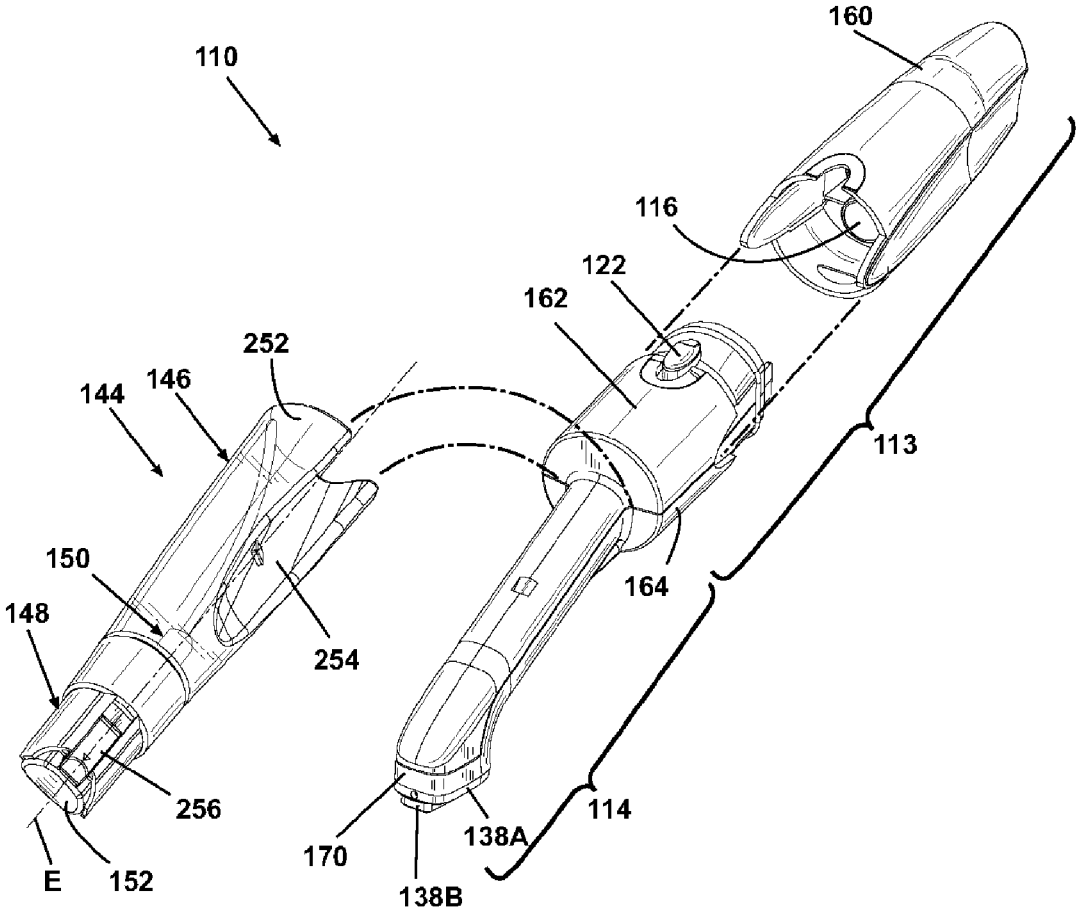
FIG. 7 is an exploded view of the compact carpet spot cleaner of FIG. 5.
Figure 8:
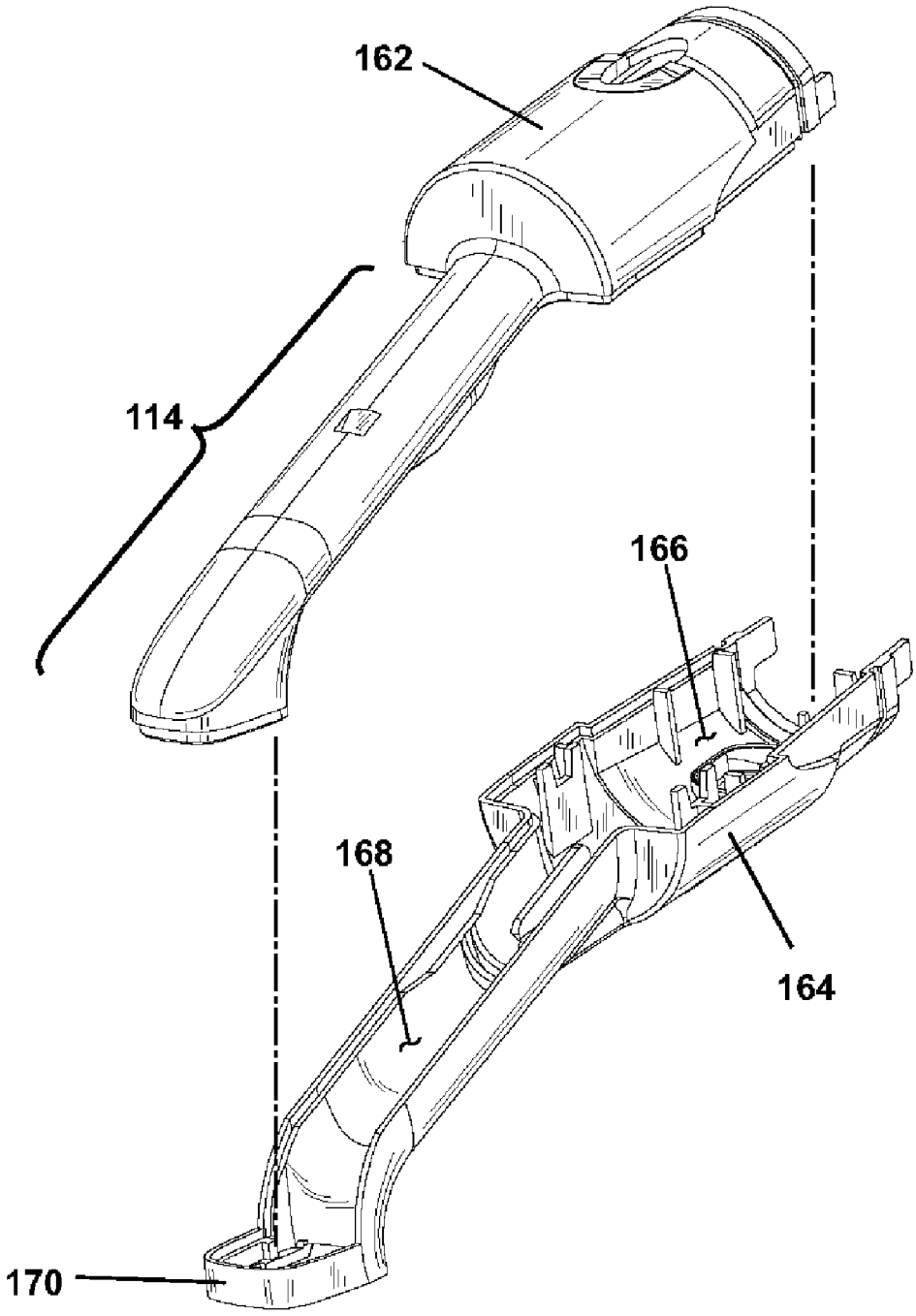
FIG. 8 is an exploded view of an upper housing and a lower housing of the main housing of FIG. 5.

Referring now to FIGS. 5-7 and 13, the liquid container assembly 144 comprises an open-top liquid container 146 having a side wall 250 and a flat bottom wall 252 that together define a liquid chamber for storing cleaning liquid. The diameter of the side wall 252 is larger near the bottom wall 252 than near the open top such that the liquid chamber is generally frusto-conical and has a longitudinal axis E (FIG. 7). The liquid container 146 further comprises an indentation 254 formed in the side wall 250 for removably mounting the liquid container assembly 144 to the main housing 112. The indentation 254 is sized to receive at least a portion of the head portion 114 and forms a friction fit therewith. The liquid container assembly 144 can be mounted to the head portion 114 in any suitable manner, such as by snap-fitting or sliding the depression 254 of the liquid container 146 onto the head portion 114. When the liquid container assembly 144 is mounted to the main housing 112, the bottom wall 252 of the liquid container 146 abuts the rear portion 113, and the liquid container assembly 144 is attached to the head portion 114 in a piggyback fashion. Preferably, the longitudinal axis E of the liquid container assembly 144 is substantially coincident with the longitudinal axis A of the rear portion 113 when the liquid container assembly 144 is mounted to the head portion 114.

Figure 13:
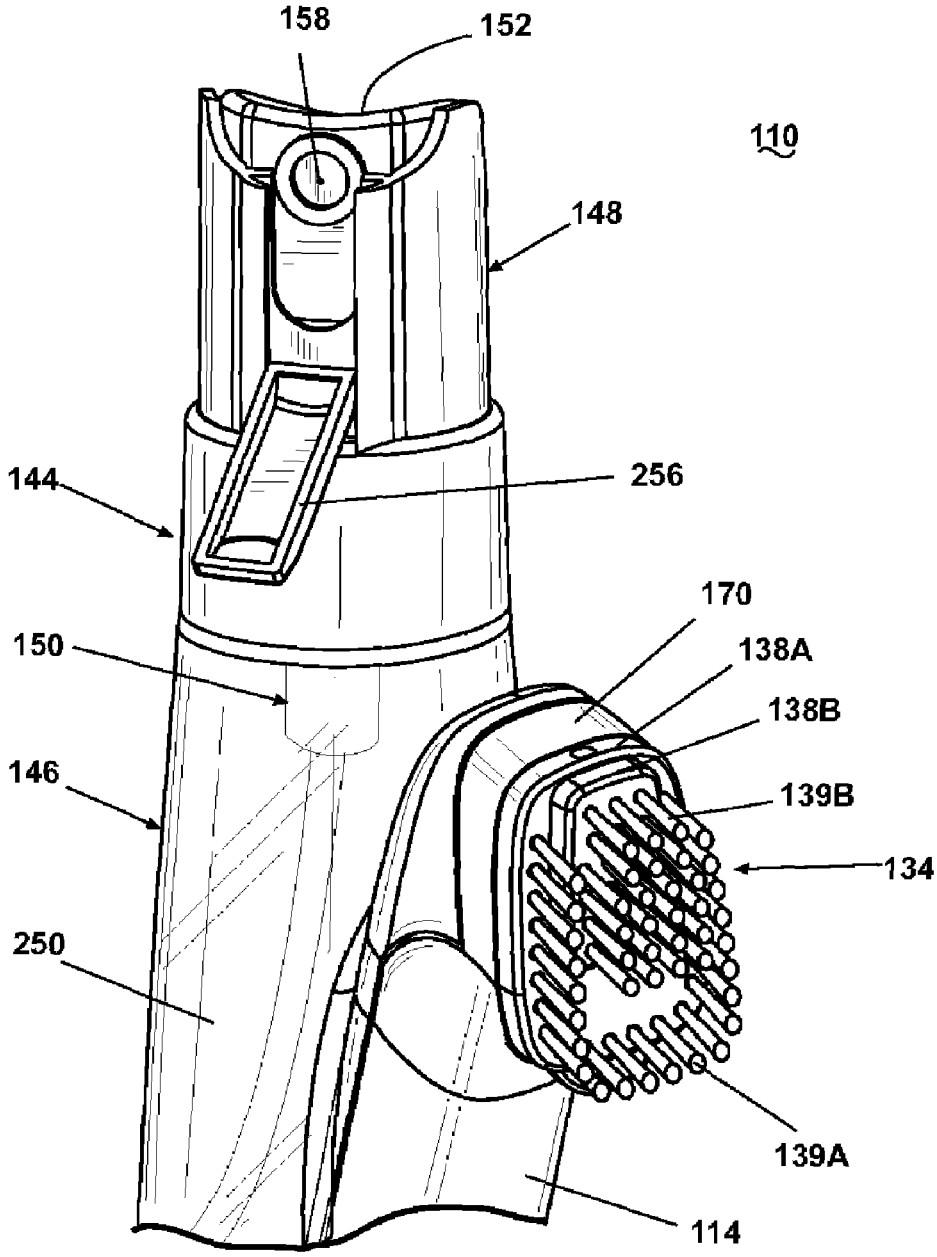
FIG. 13 is an enlarged perspective view of a dispenser head on the liquid container assembly of FIG. 5.

The liquid container assembly 144 further comprises a pump assembly 150 for dispensing the cleaning liquid stored in the liquid chamber. The pump assembly 150 can be a mechanical pump, aerosol spray mechanism, or any other suitable device for dispensing the cleaning solution. The cleaning liquid can be dispensed in an unaerated state or can be mixed with air to form a foam, as described above for the first embodiment. The pump assembly 150 comprises a dispenser head 148 with a trigger 152 that is mechanically actuated by the user to dispense the cleaning liquid through an outlet orifice, such as a nozzle 158, as shown in FIG. 13. The pump assembly 150 can further include an invertable valve assembly (not shown) so that the cleaning liquid can be dispensed from the liquid container assembly 144 regardless of the orientation of the liquid container 146. Further, the pump assembly 150 can optionally comprise a cover 256 pivotally mounted on the dispenser head 148 near the nozzle 158 for selectively closing and locking the nozzle 158 to prevent undesired dispensation of the cleaning liquid. The cover 256 preferably snap fits to the dispenser head 148 to retain the cover 256 in the closed configuration. An exemplary cover is disclosed in U.S. Pat. No. 6,382,463, which is incorporated herein by reference in its entirety.

Figure 5:
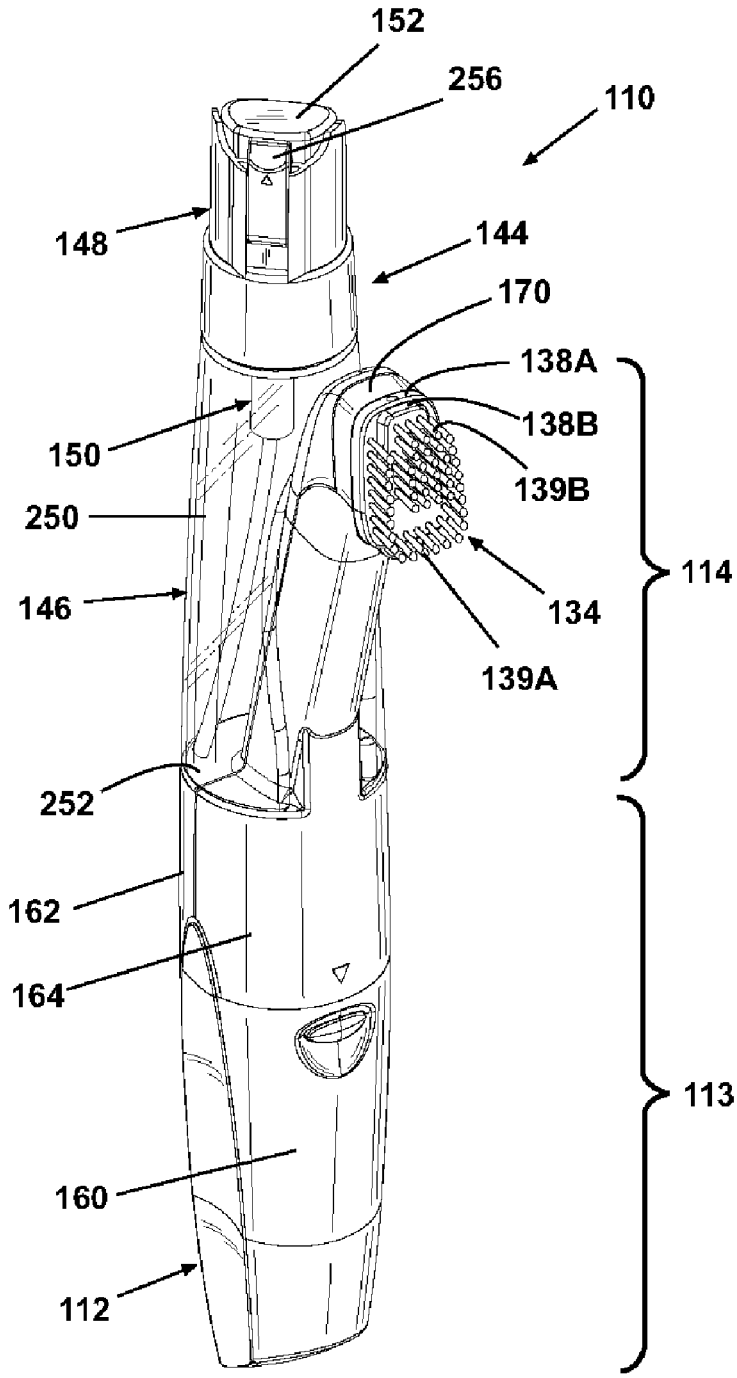
FIG. 5 is a perspective view of a third embodiment of a compact carpet spot cleaner according to the invention and comprising a main housing, a cleaning head assembly, and a liquid container assembly.

As best seen in FIGS. 5 and 13, when the liquid container assembly 144 is mounted to the main housing 112, the nozzle 158 is angularly, such as rotationally or laterally, offset from the cleaning head assembly 134 and is positioned adjacent and preferably forwardly of the cleaning head assembly 134. As a result of this configuration, the dispensation of cleaning liquid from the liquid container assembly 144 is unobstructed by the head portion 114 and the cleaning head assembly 134 and the distance between the nozzle 158 and the surface to be cleaned is not limited when dispensing the cleaning liquid from the liquid container assembly 144. Alternatively, the nozzle 158 and the cleaning head assembly 134 can be aligned.

To operate the compact carpet spot cleaner 110, the cleaning head assembly 134 is mounted to the main housing 112 as described above, and the liquid container assembly 144 is filled with the cleaning liquid, such as any of the above described Compositions A-D. To fill the liquid container assembly 144, it is pulled from the head portion 114, the pump assembly 150 is removed from the liquid container 146, and the liquid chamber is filled with the cleaning liquid. After the pump assembly 150 is reassembled to the liquid container 146, the liquid container assembly 144 is mounted to the main housing 112 by aligning the depression with 254 with the head portion 114 and sliding, snapping, or otherwise placing it thereon. Next, the user grasps the rear portion 113, pivots the cover 256 away from the nozzle 158, and rotates the compact carpet spot cleaner 110 so that the nozzle 158 faces the surface to be cleaned and can be positioned directly adjacent the surface to be cleaned, if desired. Thereafter, the user depresses the trigger 152 to dispense the cleaning liquid onto the surface.

After a sufficient amount of cleaning liquid is applied to the surface, the user rotates the compact carpet spot cleaner 110 to a position wherein the bristles 139A, 139B of the cleaning head assembly 134 contact the surface to be cleaned in an orientation generally perpendicular thereto. The user then actuates the switch 122 to supply power from the batteries 116 to the motor 118. The motor 118 rotates the motor shaft and, thus, the drive gear 182. Rotation of the drive gear 182 induces rotation of the follower gear 184 and the guides 186 about the circular center of the follower gear 184. Since the cleaning head holder shaft 136 is not fixedly mounted within the path 188 between the guides 186, the cleaning head holder shaft 136 does not rotate with the follower gear 184. However, because the circular center of the guides 186 and the path 188 is offset from the circular center of the follower gear 184, the cleaning head holder shaft 136 is laterally displaced proximally and distally during rotation of the follower gear 184. The cleaning head holder shaft 136 moves between the first position, as shown in FIG. 9B, wherein the cleaning head holder shaft 136 is displaced towards the distal end of the main housing 112, and the second position, as shown in FIG. 9C, wherein the cleaning head holder shaft 136 is displaced towards the proximal end of the main housing 112. As a result, the cleaning head holder shaft 136 moves forward and backwards within the head chamber 168, and the rod 190 slides within the angled apertures 206 in the cleaning head holder 200 at the distal end of the cleaning head holder shaft 136 to push and pull the cleaning head holder 200 forward and backwards, respectively, along the legs 212 of the U-shaped bracket 210. Because the flange 243 on the auxiliary bristle holder 138B is held between the arms 218 of the cleaning head assembly guide 208 of the cleaning head holder 200, the cleaning head assembly guide 208 pushes and pulls the auxiliary bristle holder 138B along the shaft 232 of the stationary brush holder 138A. As the auxiliary bristle holder 138B slides on the shaft 232, the second bristles 139B move relative to the first bristles 139A, i.e. between the positions shown in FIGS. 9B and 9C. The oscillation or reciprocal scrubbing action of the second bristles 139B facilitates the removal of dirt and stains from the surface to be cleaned. The user can apply pressure to the compact carpet spot cleaner 110 to press the second, more rigid bristles 139B onto the carpet. Alternatively, the user can remove the pressure so that only the first, more flexible bristles 139A contact the surface, for example, on delicate surfaces or for light stains.

Figure 14:
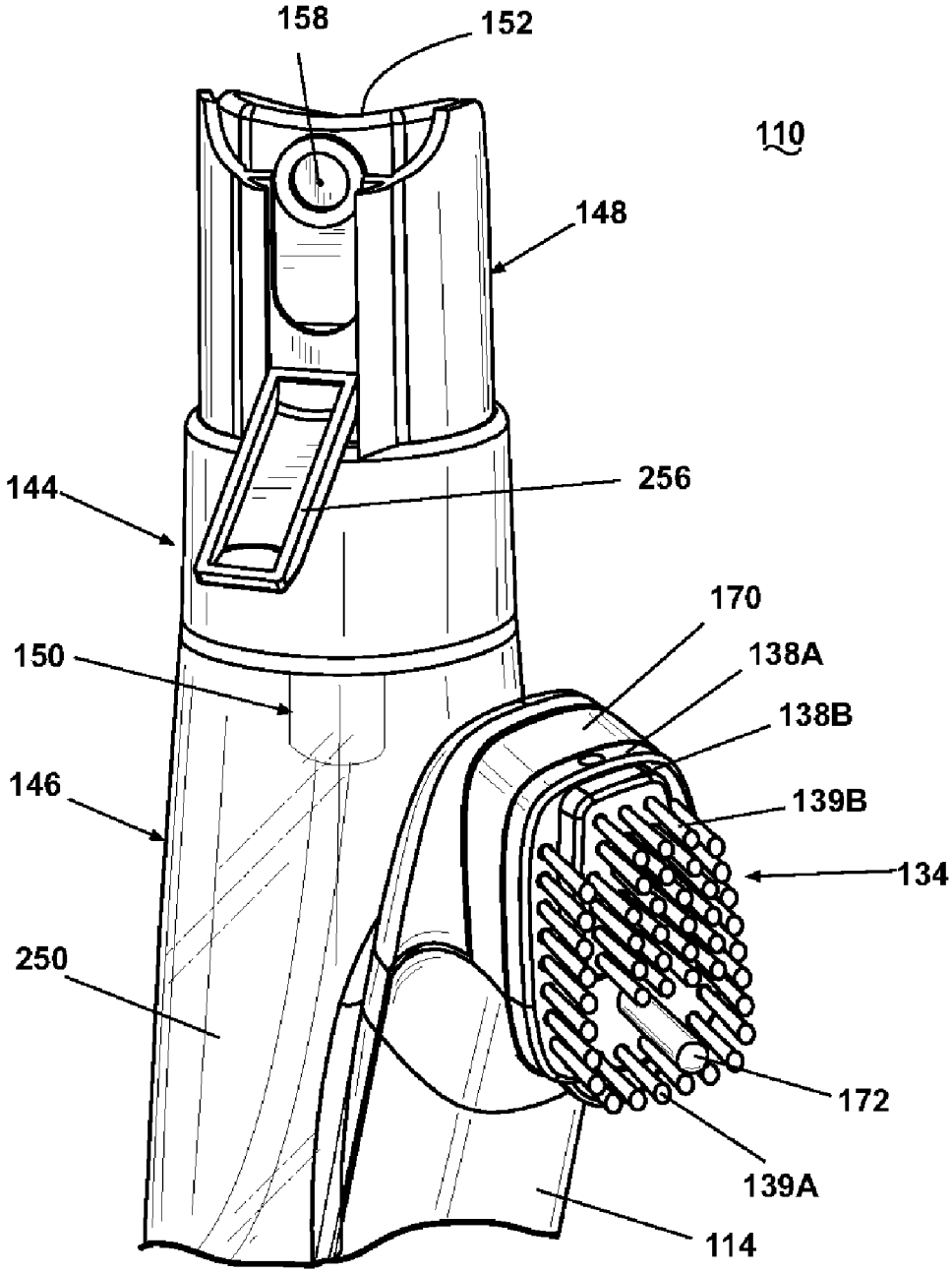
FIG. 14 is an enlarged perspective view of an alternative embodiment of a compact carpet spot cleaner according to the invention.
Figure 15:
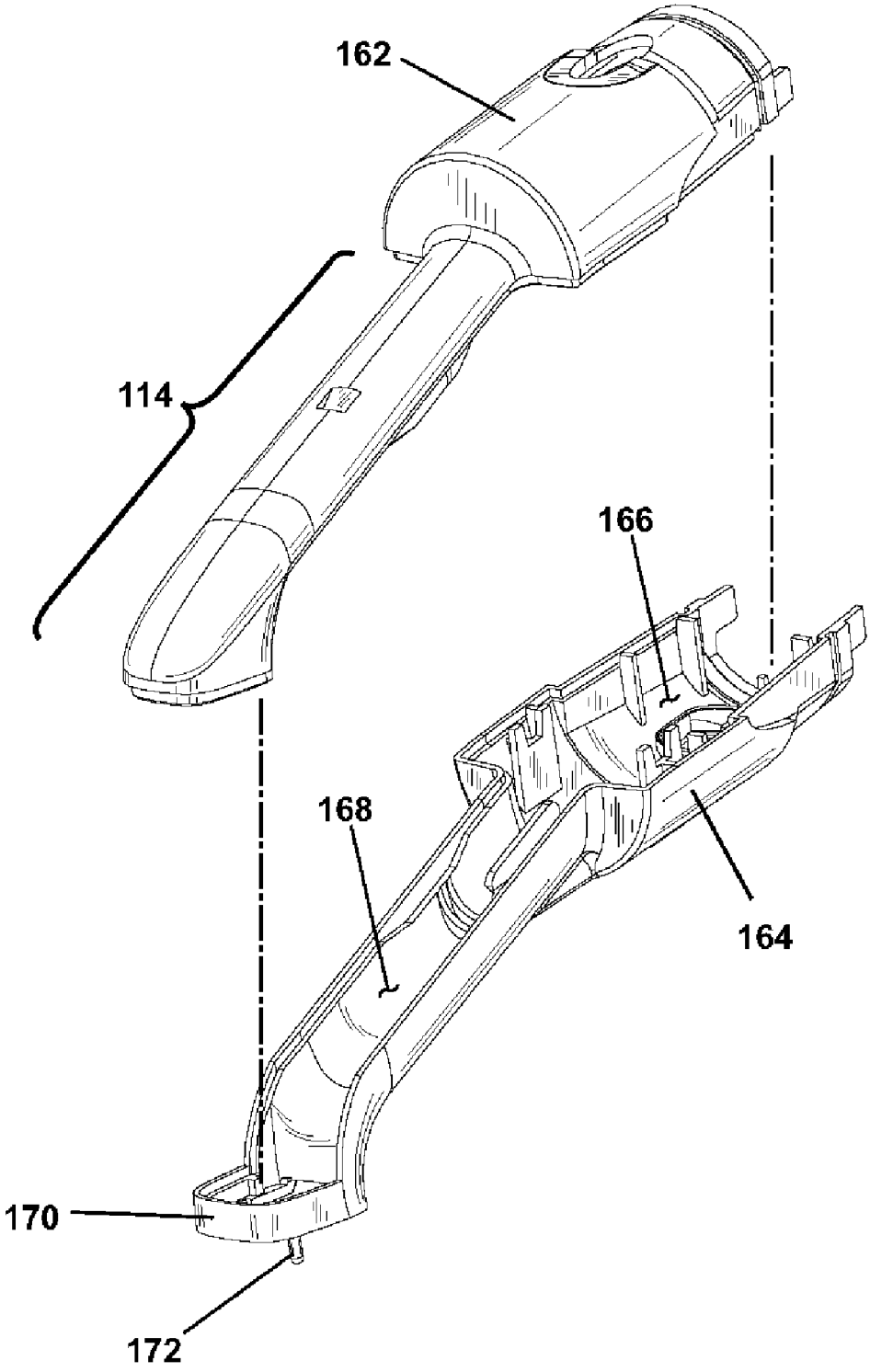
FIG. 15 is an exploded view of an upper housing and a lower housing of the compact carpet spot cleaner of FIG. 14.

Referring to FIGS. 14 and 15, in an alternate embodiment, a removable cleaning head support 170 further includes a cylindrical pressure tip 172 with a rounded end to focus hand pressure through the compact carpet spot cleaner to a stain that may appear on a carpet of bare surface to be cleaned. The pressure tip 172 is mounted to, or formed with, the fixed bristle holder 138A. It has been found that a relatively small semi-spherical surface works best for precisely applying pressure; however, other shapes, such as flat surfaces can be used for this same purpose. In a further embodiment, the pressure tip 172 can be made of a conductive or semi-conductive material. In this embodiment, an electrical circuit from the batteries 16 to a commonly known circuit board (not shown) can pulse low level voltage through the pressure tip 172 where the current draw across the tip generates heat. In operation, the user directs the liquid container nozzle 58 at the stain to be cleaned and presses the trigger 52, 152 to apply liquid. After wetting the stain, the user moves the switch 22 to the on position thereby completing the electrical path to move the bristles and draw current through the pressure tip 172. The user selectively applies mechanical brushing action and direct pressure through the pressure tip to the stain to thoroughly remove the stain from the carpet fibers.

The compact carpet spot cleaners described are not limited to cleaning soft surfaces, such as carpets, upholstery, and fabrics. The compact carpet spot cleaner can also be employed to clean hard surfaces, such as tile and linoleum. The type of cleaning liquid stored in the liquid container assembly can be selected based on the type of surface to be cleaned. Further, the cleaning head can comprise an agitator suitable for the type of surface to be cleaned. Examples of agitators include, but are not limited to, brushes (as described above), sponges, scrubbing pads, dusting pads, and ultrasonic vibrating cleaning members.

While the invention has been specifically described in connection with certain specific embodiments thereof, it is to be understood by way of illustration and not of limitation, and the scope of the appended claims be construed as broadly as the prior art would permit.

What is claimed is:

1. A handheld surface cleaning apparatus comprising:

a housing having a gripping handle at a rear portion with a first longitudinal axis and a head portion at a front portion thereof;

a cleaning head mounted to the head portion and having bristles that extend at an obtuse angle to the first longitudinal axis;

a motor within the housing and mechanically connected to the cleaning head through a drive mechanism;

a source of electrical energy connected to the motor to energize the motor;

a switch mounted on the housing and connected between the source of electrical energy and the motor to control the application of electrical energy to the motor;

a liquid container mounted on the housing and adapted to contain a cleaning fluid; and a dispenser mounted on the liquid container for dispensing the cleaning fluid from the liquid container and onto a surface to be cleaned, wherein the liquid container is removably mounted to the head portion of the housing so that the dispenser is positioned adjacent to the cleaning head;

whereby the gripping handle is ergonomically positioned for a user when the bristles are positioned substantially perpendicular to a surface to be cleaned.

2. The handheld surface cleaning apparatus according to claim 1 wherein the source of electrical energy is mounted within the gripping handle.

3. The handheld surface cleaning apparatus according to claim 1, wherein the liquid container is slidably mounted to the head portion.

4. The handheld surface cleaning apparatus according to claim 1 wherein a side wall of the liquid container mates with the head portion in piggyback fashion.

5. The handheld surface cleaning apparatus according to claim 4 wherein the side wall of the liquid container has an indentation that snap fits onto the head portion in piggyback fashion.

6. The handheld surface cleaning apparatus according to claim 4 wherein the side wall of the liquid container has an indentation that slides onto the head portion in piggyback fashion.

7. The handheld surface cleaning apparatus according to claim 1 wherein the dispenser has a manual pump for spraying liquid onto the surface to be cleaned.

8. The handheld surface cleaning apparatus according to claim 1 wherein the dispenser is positioned at a forward end of the liquid container.

9. The handheld surface cleaning apparatus according to claim 1 wherein the liquid container has a third longitudinal axis that is substantially coincident with the first longitudinal axis when the liquid container is mounted to the housing.

10. The handheld surface cleaning apparatus according to claim 9 wherein the dispenser is mounted forwardly of the cleaning head.

11. The handheld surface cleaning apparatus according to claim 10 wherein the dispenser has an outlet orifice that is offset from the cleaning head.

12. The handheld surface cleaning apparatus according to claim 1 wherein the cleaning head is removably mounted to the head portion.

13. The handheld surface cleaning apparatus according to claim 12 wherein the cleaning head snap fits onto the head portion.

14. The handheld surface cleaning apparatus according to claim 1 wherein the cleaning head bristles comprise a set of bristles that are stationary with respect to the cleaning head and a set of movable bristles that is moveable with respect to the cleaning head.

15. The handheld surface cleaning apparatus according to claim 14 wherein the set of movable bristles moves reciprocally in a forward and rearward direction.

16. The handheld surface cleaning apparatus according to claim 14 wherein one of the sets of bristles is shorter than the other set of bristles.

17. The handheld surface cleaning apparatus according to claim 16 wherein the set of movable bristles is shorter than the set of stationary bristles and is centrally located with respect to the set of stationary bristles.

18. The handheld surface cleaning apparatus according to claim 1 wherein the switch is mounted on the gripping handle so that a user can operate the switch with a thumb.

19. The handheld surface cleaning apparatus according to claim 1 wherein the obtuse angle between the first longitudinal axis and the bristles is in a range of about 95 to 120 degrees.

20. The handheld surface cleaning apparatus according to claim 19 wherein the obtuse angle between the first longitudinal axis and the bristles is about 100 degrees.

21. The handheld surface cleaning apparatus according to claim 1 wherein the head portion extends along a second longitudinal axis that is at an acute angle with respect to the first longitudinal axis.

22. The handheld surface cleaning apparatus according to claim 21 wherein the acute angle between the first longitudinal axis and the second longitudinal axis is in a range of about 10 to 30 degrees.

23. The handheld surface cleaning apparatus according to claim 22 wherein the bristles extend at an obtuse angle to the second longitudinal axis, and the obtuse angle between the bristles and the second longitudinal axis is in a range of about 110 to 130 degrees.

24. The handheld surface cleaning apparatus according to claim 23 wherein the obtuse angle between the bristles and the second longitudinal axis is about 120 degrees.

25. The handheld surface cleaning apparatus according to claim 21 wherein the difference between the acute angle between the first and second longitudinal axes and the obtuse angle between the bristles and the first longitudinal axis is greater than 90 degrees.

26. The handheld surface cleaning apparatus according to claim 1 wherein the source of electrical energy is a battery.

27. The handheld surface cleaning apparatus according to claim 1 wherein the cleaning fluid comprises a solvent, a surfactant, and a soil resist.

28. The handheld surface cleaning apparatus according to claim 27 wherein the cleaning fluid further comprises an oxidizing agent and a pH controller.

29. The handheld surface cleaning apparatus according to claim 1 wherein the cleaning fluid is a carpet cleaning fluid comprising a polymeric soil resist.

30. A handheld surface cleaning apparatus comprising:

a housing having a head portion and a rear portion with a gripping handle;

a cleaning head mounted to the head portion;

a motor within the housing and mechanically connected to the cleaning head through a drive mechanism;

a source of electrical energy connected to the motor to energize the motor;

a switch mounted on the housing and connected between the source of electrical energy and the motor to control the application of electrical energy to the motor;

a liquid container mounted on the housing and contains a cleaning fluid comprising a solvent, a surfactant, and a soil resist; and a dispenser mounted on the liquid container for dispensing the cleaning fluid from the liquid container and onto a surface to be cleaned;

wherein the dispenser has a manual pump for spraying liquid onto the surface to be cleaned, and the liquid container is removably mounted to the head portion of the housing so that the dispenser is positioned adjacent to the cleaning head.

31. The handheld surface cleaning apparatus according to claim 30 wherein the dispenser is positioned at a forward end of the liquid container.

32. The handheld surface cleaning apparatus according to claim 30, wherein the liquid container is slidably mounted to the head portion.

33. The handheld surface cleaning apparatus according to claim 30 wherein a side wall of the liquid container mates with the head portion in piggyback fashion.

34. The handheld surface cleaning apparatus according to claim 30 wherein the side wall of the liquid container has an indentation that snap fits onto the head portion in piggyback fashion.

35. The handheld surface cleaning apparatus according to claim 30 wherein the side wall of the liquid container has an indentation that slides onto the head portion in piggyback fashion.

36. The handheld surface cleaning apparatus according to claim 30 wherein the cleaning head comprises bristles.

37. The handheld surface cleaning apparatus according to claim 36 wherein the cleaning head is removably mounted to the head portion.

38. The handheld surface cleaning apparatus according to claim 36 wherein the cleaning head comprises a set of stationary bristles and a set of movable bristles that is moveable with respect to the cleaning head.

39. The handheld surface cleaning apparatus according to claim 30 wherein the source of electrical energy is a battery.

40. The handheld surface cleaning apparatus according to claim 30 wherein the cleaning fluid further comprises an oxidizing agent and a pH controller.

41. The handheld surface cleaning apparatus according to claim 30 wherein the cleaning fluid is a carpet cleaning fluid comprising a polymeric soil resist.

42. A handheld surface cleaning apparatus comprising:

a housing having a head portion and a rear portion with a gripping handle;

a cleaning head mounted to the head portion;

a motor within the housing and mechanically connected to the cleaning head through a drive mechanism;

a source of electrical energy mounted in the housing and connected to the motor to energize the motor;

a switch mounted on the housing and connected between the source of electrical energy and the motor to control the application of electrical energy to the motor;

a liquid container mounted on the housing and adapted to contain a cleaning fluid; and a dispenser mounted on the liquid container for dispensing the cleaning fluid from the liquid container and onto a surface to be cleaned;

wherein the dispenser has an outlet orifice angularly offset from the cleaning head.

43. The handheld surface cleaning apparatus according to claim 42 wherein the outlet orifice is rotationally offset from the cleaning head.

44. The handheld surface cleaning apparatus according to claim 42 wherein the outlet orifice is laterally offset from the cleaning head.

45. The handheld surface cleaning apparatus according to claim 42 wherein the dispenser is positioned at a forward end of the liquid container.

46. The handheld surface cleaning apparatus according to claim 42 wherein the liquid container is removably mounted to the head portion of the housing so that the dispenser is positioned adjacent to the cleaning head.

47. The handheld surface cleaning apparatus according to claim 46, wherein the liquid container is slidably mounted to the head portion.

48. The handheld surface cleaning apparatus according to claim 46 wherein a side wall of the liquid container mates with the head portion in piggyback fashion.

49. The handheld surface cleaning apparatus according to claim 46 wherein the side wall of the liquid container has an indentation that snap fits onto the head portion in piggyback fashion.

50. The handheld surface cleaning apparatus according to claim 46 wherein the side wall of the liquid container has an indentation that slides onto the head portion in piggyback fashion.

51. The handheld surface cleaning apparatus according to claim 42 wherein the cleaning head comprises bristles.

52. The handheld surface cleaning apparatus according to claim 51 wherein the cleaning head is removably mounted to the head portion.

53. The handheld surface cleaning apparatus according to claim 51 wherein the cleaning head comprises a set of stationary bristles and a set of movable bristles that is moveable with respect to the cleaning head.

54. The handheld surface cleaning apparatus according to claim 42 wherein the source of electrical energy is a battery.

55. The handheld surface cleaning apparatus according to claim 42 wherein the cleaning fluid comprises a solvent, a surfactant, and a soil resist.

56. The handheld surface cleaning apparatus according to claim 55 wherein the cleaning fluid further comprises an oxidizing agent and a pH controller.

57. The handheld surface cleaning apparatus according to claim 42 wherein the cleaning fluid is a carpet cleaning fluid comprising a polymeric soil resist.

* * * * *

UNITED STATES PATENT AND TRADEMARK OFFICE

CERTIFICATE OF CORRECTION

PATENT NO. : 7,631,386 B1
APPLICATION NO. : 10/904331
DATED : December 15, 2009
INVENTOR(S) : Santiago et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1410 days.

Signed and Sealed this

Second Day of November, 2010

David J. Kappos

David J. Kappos
*Director of the United States Patent and Trademark Office*